US007571771B2

(12) United States Patent
Pratt et al.

(10) Patent No.: US 7,571,771 B2
(45) Date of Patent: Aug. 11, 2009

(54) CAVITY WELL SYSTEM

(75) Inventors: Christopher A. Pratt, Cochrane, Alberta (CA); Douglas P. Seams, Calgary, Alberta (CA)

(73) Assignee: CDX Gas, LLC, Houston, TX (US)

( * ) Notice: Subject to any disclaimer, the term of this patent is extended or adjusted under 35 U.S.C. 154(b) by 174 days.

(21) Appl. No.: 11/141,335

(22) Filed: May 31, 2005

(65) Prior Publication Data

US 2006/0266521 A1 Nov. 30, 2006

(51) Int. Cl.
*E21B 43/00* (2006.01)

(52) U.S. Cl. ..... 166/313; 166/50; 166/52

(58) Field of Classification Search ..... 166/50, 166/278, 313

See application file for complete search history.

(56) References Cited

U.S. PATENT DOCUMENTS

| | | | | |
|---|---|---|---|---|
| 54,144 | A | | 4/1866 | Hamar |
| 274,740 | A | | 3/1883 | Douglass |
| 526,708 | A | | 10/1894 | Horton |
| 639,036 | A | | 12/1899 | Heald |
| 1,189,560 | A | | 7/1916 | Gondos |
| 1,285,347 | A | | 11/1918 | Otto |
| 1,467,480 | A | | 9/1923 | Hogue |
| 1,485,615 | A | | 3/1924 | Jones |
| 1,488,106 | A | | 3/1924 | Fitzpatrick |
| 1,520,737 | A | | 12/1924 | Wright |
| 1,674,392 | A | | 6/1928 | Flansburg |
| 1,777,961 | A | | 10/1930 | Capeliuschnicoff |
| 2,018,285 | A | | 10/1935 | Schweitzer et al. |
| 2,069,482 | A | | 2/1937 | Seay |
| 2,150,228 | A | | 3/1939 | Lamb |
| 2,169,718 | A | | 8/1939 | Böll et al. |
| 2,335,085 | A | | 11/1943 | Roberts |
| 2,450,223 | A | | 9/1948 | Barbour |
| 2,452,654 | A | * | 11/1948 | Hayes et al. ..... 166/278 |
| 2,490,350 | A | | 12/1949 | Grable |
| 2,679,903 | A | | 6/1954 | McGowen, Jr. et al. |
| 2,726,063 | A | | 12/1955 | Ragland et al. |
| 2,726,847 | A | | 12/1955 | McCune et al. |
| 2,783,018 | A | | 2/1957 | Lytle |
| 2,797,893 | A | | 7/1957 | McCune et al. |
| 2,847,189 | A | | 8/1958 | Shook |
| 2,911,008 | A | | 11/1959 | Du Bois |

(Continued)

FOREIGN PATENT DOCUMENTS

| | | | |
|---|---|---|---|
| AU | 85/49964 | A | 11/1986 |

(Continued)

OTHER PUBLICATIONS

McCray, Arthur, et al., "*Oil Well Drilling Technology*," University of Oklahoma Press, 1959, Title Page, Copyright Page and pp. 315-319 (7 pages).

(Continued)

*Primary Examiner*—David J. Bagnell
*Assistant Examiner*—Cathleen R Hutchins
(74) *Attorney, Agent, or Firm*—Fish & Richardson P.C.

(57) ABSTRACT

A method for accessing a subterranean zone includes forming a subterranean cavity coupled to a land surface and forming a plurality of substantially horizontal bores extending at least partially into the subterranean zone and intersecting the cavity.

31 Claims, 7 Drawing Sheets

U.S. PATENT DOCUMENTS

| | | | | |
|---|---|---|---|---|
| 2,934,904 | A | | 5/1960 | Hendrix |
| 2,980,142 | A | | 4/1961 | Turak |
| 3,163,211 | A | | 12/1964 | Henley |
| 3,208,537 | A | | 9/1965 | Scarborough |
| 3,347,595 | A | | 10/1967 | Dahms et al. |
| 3,362,475 | A | * | 1/1968 | Huitt et al. ..... 166/278 |
| 3,385,382 | A | | 5/1968 | Canalizo et al. |
| 3,443,648 | A | | 5/1969 | Howard |
| 3,473,571 | A | | 10/1969 | Dugay |
| 3,503,377 | A | | 3/1970 | Beatenbough et al. |
| 3,528,516 | A | | 9/1970 | Brown |
| 3,530,675 | A | | 9/1970 | Turzillo |
| 3,534,822 | A | | 10/1970 | Campbell et al. |
| 3,578,077 | A | | 5/1971 | Glenn, Jr. et al. |
| 3,582,138 | A | | 6/1971 | Loofbourow et al. |
| 3,587,743 | A | | 6/1971 | Howard |
| 3,684,041 | A | | 8/1972 | Kammerer, Jr. et al. |
| 3,687,204 | A | | 8/1972 | Marshall et al. |
| 3,692,041 | A | | 9/1972 | Bondi |
| 3,744,565 | A | | 7/1973 | Brown |
| 3,757,876 | A | | 9/1973 | Pereau |
| 3,757,877 | A | | 9/1973 | Leathers |
| 3,759,328 | A | | 9/1973 | Ueber et al. |
| 3,763,652 | A | | 10/1973 | Rinta |
| 3,800,830 | A | | 4/1974 | Etter |
| 3,809,519 | A | | 5/1974 | Garner |
| 3,825,081 | A | | 7/1974 | McMahon |
| 3,828,867 | A | | 8/1974 | Elwood |
| 3,874,413 | A | | 4/1975 | Valdez |
| 3,887,008 | A | | 6/1975 | Canfield |
| 3,902,322 | A | | 9/1975 | Watanabe |
| 3,907,045 | A | | 9/1975 | Dahl et al. |
| 3,934,649 | A | | 1/1976 | Pasini, III et al. |
| 3,957,082 | A | | 5/1976 | Fuson et al. |
| 3,961,824 | A | | 6/1976 | Van Eek et al. |
| 4,011,890 | A | | 3/1977 | Andersson |
| 4,020,901 | A | | 5/1977 | Pisio et al. |
| 4,022,279 | A | | 5/1977 | Driver |
| 4,030,310 | A | | 6/1977 | Schirtzinger |
| 4,037,658 | A | | 7/1977 | Anderson |
| 4,060,130 | A | | 11/1977 | Hart |
| 4,073,351 | A | | 2/1978 | Baum |
| 4,089,374 | A | | 5/1978 | Terry |
| 4,116,012 | A | | 9/1978 | Abe et al. |
| 4,134,463 | A | | 1/1979 | Allen |
| 4,136,996 | A | | 1/1979 | Burns |
| 4,151,880 | A | | 5/1979 | Vann |
| 4,156,437 | A | | 5/1979 | Chivens et al. |
| 4,169,510 | A | | 10/1979 | Meigs |
| 4,182,423 | A | | 1/1980 | Ziebarth et al. |
| 4,189,184 | A | | 2/1980 | Green |
| 4,220,203 | A | | 9/1980 | Steeman |
| 4,221,433 | A | | 9/1980 | Jacoby |
| 4,222,611 | A | | 9/1980 | Larson et al. |
| 4,224,989 | A | | 9/1980 | Blount |
| 4,226,475 | A | | 10/1980 | Frosch et al. |
| 4,257,650 | A | * | 3/1981 | Allen ..... 166/272.3 |
| 4,278,137 | A | | 7/1981 | Van Eek |
| 4,283,088 | A | | 8/1981 | Tabakov et al. |
| 4,296,785 | A | | 10/1981 | Vitello et al. |
| 4,296,969 | A | | 10/1981 | Willman |
| 4,299,295 | A | | 11/1981 | Gossard |
| 4,303,127 | A | | 12/1981 | Freel et al. |
| 4,305,464 | A | | 12/1981 | Masszi |
| 4,312,377 | A | | 1/1982 | Knecht |
| 4,317,492 | A | | 3/1982 | Summers et al. |
| 4,328,577 | A | | 5/1982 | Abbott et al. |
| 4,333,539 | A | | 6/1982 | Lyons et al. |
| 4,356,866 | A | | 11/1982 | Savins |
| 4,366,988 | A | | 1/1983 | Bodine |
| 4,372,398 | A | | 2/1983 | Kuckes |
| 4,386,665 | A | | 6/1983 | Dellinger |
| 4,390,067 | A | | 6/1983 | Willman |
| 4,396,075 | A | | 8/1983 | Wood et al. |
| 4,396,076 | A | | 8/1983 | Inoue |
| 4,397,360 | A | | 8/1983 | Schmidt |
| 4,401,171 | A | | 8/1983 | Fuchs |
| 4,407,376 | A | | 10/1983 | Inoue |
| 4,415,205 | A | | 11/1983 | Rehm et al. |
| 4,417,829 | A | | 11/1983 | Berezoutzky |
| 4,422,505 | A | | 12/1983 | Collins |
| 4,437,706 | A | | 3/1984 | Johnson |
| 4,442,896 | A | | 4/1984 | Reale et al. |
| 4,458,767 | A | | 7/1984 | Hoehn, Jr. |
| 4,463,988 | A | | 8/1984 | Bouck et al. |
| 4,494,616 | A | | 1/1985 | McKee |
| 4,502,733 | A | | 3/1985 | Grubb |
| 4,512,422 | A | | 4/1985 | Knisley |
| 4,519,463 | A | | 5/1985 | Schuh |
| 4,527,639 | A | | 7/1985 | Dickinson, III et al. |
| 4,532,986 | A | | 8/1985 | Mims et al. |
| 4,533,182 | A | | 8/1985 | Richards |
| 4,536,035 | A | | 8/1985 | Huffman et al. |
| 4,544,037 | A | | 10/1985 | Terry |
| 4,558,744 | A | | 12/1985 | Gibb |
| 4,565,252 | A | | 1/1986 | Campbell et al. |
| 4,573,541 | A | | 3/1986 | Josse et al. |
| 4,600,061 | A | | 7/1986 | Richards |
| 4,603,592 | A | | 8/1986 | Siebold et al. |
| 4,605,076 | A | | 8/1986 | Goodhart |
| 4,611,855 | A | | 9/1986 | Richards |
| 4,618,009 | A | | 10/1986 | Carter et al. |
| 4,638,949 | A | | 1/1987 | Mancel |
| 4,646,836 | A | | 3/1987 | Goodhart |
| 4,651,836 | A | | 3/1987 | Richards |
| 4,662,440 | A | | 5/1987 | Harmon et al. |
| 4,674,579 | A | | 6/1987 | Geller et al. |
| 4,676,313 | A | | 6/1987 | Rinaldi |
| 4,702,314 | A | | 10/1987 | Huang et al. |
| 4,705,109 | A | | 11/1987 | Ledent et al. |
| 4,705,431 | A | | 11/1987 | Gadelle et al. |
| 4,715,440 | A | | 12/1987 | Boxell et al. |
| 4,718,485 | A | | 1/1988 | Brown et al. |
| RE32,623 | E | | 3/1988 | Marshall et al. |
| 4,727,937 | A | | 3/1988 | Shum et al. |
| 4,753,485 | A | | 6/1988 | Goodhart |
| 4,754,808 | A | | 7/1988 | Harmon et al. |
| 4,754,819 | A | | 7/1988 | Dellinger |
| 4,756,367 | A | | 7/1988 | Puri et al. |
| 4,763,734 | A | | 8/1988 | Dickinson et al. |
| 4,773,488 | A | | 9/1988 | Bell et al. |
| 4,776,638 | A | | 10/1988 | Hahn |
| 4,830,105 | A | | 5/1989 | Petermann |
| 4,832,122 | A | | 5/1989 | Corey et al. |
| 4,836,611 | A | | 6/1989 | El-Saie |
| 4,842,081 | A | | 6/1989 | Parant |
| 4,844,182 | A | | 7/1989 | Tolle |
| 4,852,666 | A | | 8/1989 | Brunet et al. |
| 4,883,122 | A | | 11/1989 | Puri et al. |
| 4,889,186 | A | | 12/1989 | Hanson et al. |
| 4,978,172 | A | | 12/1990 | Schwoebel et al. |
| 5,016,709 | A | | 5/1991 | Combe et al. |
| 5,016,710 | A | | 5/1991 | Renard et al. |
| 5,033,550 | A | | 7/1991 | Johnson et al. |
| 5,035,605 | A | | 7/1991 | Dinerman et al. |
| 5,036,921 | A | | 8/1991 | Pittard et al. |
| 5,074,360 | A | | 12/1991 | Guinn |
| 5,074,365 | A | | 12/1991 | Kuckes |
| 5,074,366 | A | | 12/1991 | Karlsson et al. |
| 5,082,054 | A | | 1/1992 | Kiamanesh |
| 5,111,893 | A | | 5/1992 | Kvello-Aune |
| 5,115,872 | A | | 5/1992 | Brunet et al. |
| 5,127,457 | A | | 7/1992 | Stewart et al. |
| 5,135,058 | A | | 8/1992 | Millgard et al. |

5,148,875 A 9/1992 Karlsson et al.
5,148,877 A 9/1992 MacGregor
5,165,491 A 11/1992 Wilson
5,168,942 A 12/1992 Wydrinski
5,174,374 A 12/1992 Hailey
5,193,620 A 3/1993 Braddick
5,194,859 A 3/1993 Warren
5,197,553 A 3/1993 Leturno
5,197,783 A 3/1993 Theimer et al.
5,199,496 A 4/1993 Redus et al.
5,201,817 A 4/1993 Hailey
5,207,271 A 5/1993 Sanchez et al.
5,217,076 A 6/1993 Masek
5,226,495 A 7/1993 Jennings, Jr.
5,240,350 A 8/1993 Yamaguchi et al.
5,242,017 A 9/1993 Hailey
5,242,025 A 9/1993 Neill et al.
5,246,273 A 9/1993 Rosar
5,255,741 A 10/1993 Alexander
5,271,472 A 12/1993 Leturno
5,287,926 A 2/1994 Grupping
5,289,888 A 3/1994 Talley
5,301,760 A 4/1994 Graham
5,343,965 A 9/1994 Talley et al.
5,355,967 A 10/1994 Mueller et al.
5,363,927 A 11/1994 Frank
5,385,205 A 1/1995 Hailey
5,394,950 A 3/1995 Gardes
5,402,851 A 4/1995 Baiton
5,411,082 A 5/1995 Kennedy
5,411,085 A 5/1995 Moore et al.
5,411,088 A 5/1995 LeBlanc et al.
5,411,104 A 5/1995 Stanley
5,411,105 A 5/1995 Gray
5,431,220 A 7/1995 Lennon et al.
5,431,482 A 7/1995 Russo
5,435,400 A 7/1995 Smith
5,447,416 A 9/1995 Wittrisch
5,450,902 A 9/1995 Matthews
5,454,419 A 10/1995 Vloedman
5,458,209 A 10/1995 Hayes et al.
5,462,116 A 10/1995 Carroll
5,462,120 A 10/1995 Gondouin
5,469,155 A 11/1995 Archambeault et al.
5,477,923 A 12/1995 Jordan, Jr. et al.
5,485,089 A 1/1996 Kuckes
5,494,121 A 2/1996 Nackerud
5,499,687 A 3/1996 Lee
5,501,273 A 3/1996 Puri
5,501,279 A 3/1996 Garg et al.
5,520,252 A 5/1996 McNair
5,584,605 A 12/1996 Beard et al.
5,613,242 A 3/1997 Oddo
5,615,739 A 4/1997 Dallas
5,653,286 A 8/1997 McCoy et al.
5,664,911 A 9/1997 Bridges et al.
5,669,444 A 9/1997 Riese et al.
5,676,207 A 10/1997 Simon et al.
5,680,901 A 10/1997 Gardes
5,690,390 A 11/1997 Bithell
5,697,445 A 12/1997 Graham
5,706,871 A 1/1998 Andersson et al.
5,720,356 A 2/1998 Gardes
5,727,629 A 3/1998 Blizzard, Jr. et al.
5,733,067 A 3/1998 Hunt et al.
5,735,350 A 4/1998 Longbottom et al.
5,771,976 A 6/1998 Talley
5,775,433 A 7/1998 Hammett et al.
5,775,443 A 7/1998 Lott
5,785,133 A 7/1998 Murray et al.
5,832,958 A 11/1998 Cheng
5,853,054 A 12/1998 McGarian et al.
5,853,056 A 12/1998 Landers
5,853,224 A 12/1998 Riese
5,863,283 A 1/1999 Gardes
5,868,202 A 2/1999 Hsu
5,868,210 A 2/1999 Johnson et al.
5,879,057 A 3/1999 Schwoebel et al.
5,884,704 A 3/1999 Longbottom et al.
5,917,325 A 6/1999 Smith
5,934,390 A 8/1999 Uthe
5,938,004 A 8/1999 Roberts et al.
5,941,307 A 8/1999 Tubel
5,941,308 A 8/1999 Malone et al.
5,944,107 A 8/1999 Ohmer
5,957,539 A 9/1999 Durup et al.
5,971,074 A 10/1999 Longbottom et al.
5,988,278 A 11/1999 Johnson
5,992,524 A 11/1999 Graham
6,012,520 A 1/2000 Yu et al.
6,015,012 A 1/2000 Reddick
6,019,173 A 2/2000 Saurer et al.
6,024,171 A 2/2000 Montgomery et al.
6,030,048 A 2/2000 Hsu
6,050,335 A 4/2000 Parsons
6,056,059 A 5/2000 Ohmer
6,062,306 A 5/2000 Gano et al.
6,065,550 A 5/2000 Gardes
6,065,551 A 5/2000 Gourley et al.
6,079,495 A 6/2000 Ohmer
6,089,322 A 7/2000 Kelley et al.
6,119,771 A 9/2000 Gano et al.
6,119,776 A 9/2000 Graham et al.
6,135,208 A 10/2000 Gano et al.
6,170,571 B1 1/2001 Ohmer
6,179,054 B1 1/2001 Stewart
6,189,616 B1 2/2001 Gano et al.
6,192,988 B1 2/2001 Tubel
6,199,633 B1 3/2001 Longbottom
6,209,636 B1 4/2001 Roberts et al.
6,237,284 B1 5/2001 Erickson
6,244,340 B1 6/2001 McGlothen et al.
6,247,532 B1 6/2001 Ohmer
6,263,965 B1 7/2001 Schmidt et al.
6,279,658 B1 8/2001 Donovan et al.
6,280,000 B1 * 8/2001 Zupanick ..... 299/12
6,283,216 B1 9/2001 Ohmer
6,318,457 B1 11/2001 Den Boer et al.
6,349,769 B1 2/2002 Ohmer
6,357,523 B1 3/2002 Zupanick
6,357,530 B1 3/2002 Kennedy et al.
6,425,448 B1 7/2002 Zupanick et al.
6,439,320 B2 8/2002 Zupanick
6,450,256 B2 9/2002 Mones
6,454,000 B1 9/2002 Zupanick
6,457,525 B1 10/2002 Scott
6,457,540 B2 10/2002 Gardes
6,470,978 B2 10/2002 Trueman et al.
6,478,085 B2 11/2002 Zupanick
6,491,101 B2 12/2002 Ohmer
6,497,556 B2 12/2002 Zupanick et al.
6,554,063 B2 4/2003 Ohmer
6,557,628 B2 5/2003 Ohmer
6,561,277 B2 5/2003 Algeory et al.
6,561,288 B2 5/2003 Zupanick
6,564,867 B2 5/2003 Ohmer
6,566,649 B1 5/2003 Mickael
6,571,888 B2 6/2003 Comeau et al.
6,575,235 B2 6/2003 Zupanick et al.
6,575,255 B1 6/2003 Rial et al.
6,577,129 B1 6/2003 Thompson et al.
6,581,455 B1 6/2003 Berger et al.
6,581,685 B2 6/2003 Burgess et al.
6,585,061 B2 7/2003 Radzinski et al.
6,590,202 B2 7/2003 Mickael
6,591,903 B2 7/2003 Ingle et al.

| | | | |
|---|---|---|---|
| 6,591,922 | B1 | 7/2003 | Rial et al. |
| 6,595,301 | B1 | 7/2003 | Diamond et al. |
| 6,595,302 | B1 | 7/2003 | Diamond et al. |
| 6,598,686 | B1 | 7/2003 | Zupanick |
| 6,604,580 | B2 | 8/2003 | Zupanick et al. |
| 6,604,910 | B1 | 8/2003 | Zupanick |
| 6,607,042 | B2 | 8/2003 | Hoyer et al. |
| 6,636,159 | B1 | 10/2003 | Winnacker |
| 6,639,210 | B2 | 10/2003 | Odom et al. |
| 6,644,422 | B1 | 11/2003 | Rial et al. |
| 6,646,441 | B2 | 11/2003 | Thompson et al. |
| 6,653,839 | B2 | 11/2003 | Yuratich et al. |
| 6,662,870 | B1 | 12/2003 | Zupanick et al. |
| 6,668,918 | B2 | 12/2003 | Zupanick |
| 6,679,322 | B1 | 1/2004 | Zupanick |
| 6,681,855 | B2 | 1/2004 | Zupanick et al. |
| 6,688,388 | B2 | 2/2004 | Zupanick |
| 6,708,764 | B2 | 3/2004 | Zupanick |
| 6,722,452 | B1 | 4/2004 | Rial et al. |
| 6,725,922 | B2 | 4/2004 | Zupanick |
| 6,732,792 | B2 | 5/2004 | Zupanick |
| 6,745,855 | B2 | 6/2004 | Gardes |
| 6,758,279 | B2 | 7/2004 | Moore et al. |
| 6,758,289 | B2 | 7/2004 | Kelley et al. |
| 6,766,859 | B2 | 7/2004 | Haugen et al. |
| RE38,642 | E | 11/2004 | Gondouin |
| 6,848,508 | B2 | 2/2005 | Zupanick |
| 6,851,479 | B1 | 2/2005 | Zupanick et al. |
| 6,860,147 | B2 | 3/2005 | Gunter et al. |
| 6,866,106 | B2 | 3/2005 | Trueman et al. |
| 6,923,275 | B2 | 8/2005 | Gardes |
| 6,932,168 | B2 | 8/2005 | Morgan et al. |
| 6,942,030 | B2 | 9/2005 | Zupanick |
| 6,953,088 | B2 | 10/2005 | Rial et al. |
| 6,962,030 | B2 | 11/2005 | Conn |
| 6,964,298 | B2 | 11/2005 | Zupanick |
| 6,964,308 | B1 | 11/2005 | Zupanick |
| 6,968,893 | B2 | 11/2005 | Rusby et al. |
| 6,976,533 | B2 | 12/2005 | Zupanick |
| 6,976,547 | B2 | 12/2005 | Rial et al. |
| 6,986,388 | B2 | 1/2006 | Zupanick et al. |
| 6,988,548 | B2 | 1/2006 | Diamond et al. |
| 6,991,047 | B2 | 1/2006 | Zupanick |
| 6,991,048 | B2 | 1/2006 | Zupanick |
| 7,025,137 | B2 | 4/2006 | Zupanick |
| 7,025,154 | B2 | 4/2006 | Zupanick |
| 7,036,584 | B2 | 5/2006 | Zupanick et al. |
| 7,048,049 | B2 | 5/2006 | Zupanick |
| 7,100,687 | B2 | 9/2006 | Pauley |
| 2002/0043404 | A1 | 4/2002 | Trueman et al. |
| 2002/0096336 | A1 | 7/2002 | Zupanick et al. |
| 2003/0234120 | A1 | 12/2003 | Paluch et al. |
| 2004/0033557 | A1 | 2/2004 | Scott et al. |
| 2004/0035582 | A1 | 2/2004 | Zupanick |
| 2004/0050554 | A1 | 3/2004 | Zupanick et al. |
| 2004/0108110 | A1 | 6/2004 | Zupanick |
| 2004/0140129 | A1 | 7/2004 | Gardes |
| 2004/0206493 | A1 | 10/2004 | Zupanick et al. |
| 2004/0244974 | A1 | 12/2004 | Zupanick et al. |
| 2005/0087340 | A1 | 4/2005 | Zupanick et al. |
| 2005/0109505 | A1 | 5/2005 | Seams |
| 2005/0115709 | A1 | 6/2005 | Zupanick et al. |
| 2005/0133219 | A1 | 6/2005 | Zupanick |
| 2005/0167156 | A1 | 8/2005 | Zupanick |
| 2005/0189114 | A1 | 9/2005 | Zupanick |
| 2005/0211473 | A1 | 9/2005 | Zupanick |
| 2005/0252689 | A1 | 11/2005 | Gardes |
| 2005/0257962 | A1 | 11/2005 | Zupanick |
| 2006/0000607 | A1 * | 1/2006 | Surjaatmadja et al. ..... 166/265 |
| 2006/0096755 | A1 | 5/2006 | Zupanick |

FOREIGN PATENT DOCUMENTS

| | | | |
|---|---|---|---|
| CA | 2210866 | | 1/1998 |
| CA | 2278735 | | 8/1998 |
| CH | 653741 | A5 | 1/1986 |
| CN | 2248254 | Y | 2/1997 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 255 033 | A | 10/1992 |
| GB | 2 297 988 | A | 8/1996 |
| GB | 2 347 157 | A | 8/2000 |
| RU | 2097536 | C1 | 11/1997 |
| RU | 2136566 | C1 | 9/1999 |
| RU | 2176311 | C2 | 11/2001 |
| RU | 2179234 | C1 | 2/2002 |
| RU | 2205935 | C1 | 6/2003 |
| SU | 750108 | | 6/1975 |
| SU | 876968 | | 10/1981 |
| SU | 1448078 | A1 | 3/1987 |
| SU | 1770570 | A1 | 3/1990 |
| SU | 1709076 | A1 | 1/1992 |
| UA | 37720 | A | 5/2001 |
| WO | WO 94/21889 | | 9/1994 |
| WO | WO 94/28280 | | 12/1994 |
| WO | WO 97/21900 | | 6/1997 |
| WO | WO 98/25005 | | 6/1998 |
| WO | WO 98/35133 | | 8/1998 |
| WO | WO 99/60248 | | 11/1999 |
| WO | WO 00/31376 | | 6/2000 |
| WO | WO 00/79099 | A1 | 12/2000 |
| WO | WO 01/44620 | A1 | 6/2001 |
| WO | WO 02/18738 | A1 | 3/2002 |
| WO | WO 02/059455 | A1 | 8/2002 |
| WO | WO 02/061238 | A1 | 8/2002 |
| WO | WO 03/036023 | A1 | 5/2003 |
| WO | WO 03/038233 | | 5/2003 |
| WO | WO 03/102348 | A2 | 12/2003 |
| WO | WO 2004/035984 | A1 | 4/2004 |
| WO | WO 2005/003509 | A1 | 1/2005 |
| WO | WO 2005/012688 | | 2/2005 |

OTHER PUBLICATIONS

Berger, Bill, et al., "*Modern Petroleum: A Basic Primer of the Industry*," PenWell Books, 1978, Title Page, Copyright Page, and pp. 106-108 (5 pages).

Jones, Arfon H., et al., "*A Review of the Physical and Mechanical Properties of Coal with Implications for Coal-Bed Methane Well Completion and Production*," Rocky Mountain Association of Geologists, 1988, pp. 169-181 (13 pages).

Hartman, Howard L., et al., "*SME Mining Engineering Handbook*," Society for Mining, Metallurgy, and Exploration, Inc., 2nd Edition, vol. 2, 1992, Title Page, pp. 1946-1950 (6 pages).

Hassan, Dave, et al., "*Multi-Lateral Technique Lowers Drilling Costs, Provides Environmental Benefits*," Drilling Technology, Oct. 1999, pp. 41-47 (7 pages).

Ramaswamy, Gopal, "*Production History Provides CBM Insights*," Oil & Gas Journal, Apr. 2, 2001, pp. 49-50 and 52 (3 pages).

Chi, Weiguo, et al., "*Feasibility of Coalbed Methane Exploitation in China*," Horizontal Well Technology, Sep. 2001, Title Page and p. 74 (2 pages).

Nackerud Product Description, Harvest Tool Company, LLC, Received Sep. 27, 2001, 1 page.

Ramaswamy, Gopal, "*Advances Key For Coalbed Methane*," The American Oil & Gas Reporter, Oct. 2001, Title Page and pp. 71 and 73 (3 pages).
Stevens, Joseph C., "*Horizontal Applications for Coal Bed Methane Recovery*," Strategic Research Institute, 3rd Annual Coalbed and Coal Mine Methane Conference, Slides, Mar. 25, 2002, Title Page, Introduction Page and pp. 1-10 (13 pages).
Stayton, R.J. "Bob", "*Horizontal Wells Boost CBM Recovery*," Special Report: Horizontal and Directional Drilling, The American Oil and Gas Reporter, Aug. 2002, pp. 71, 73-75 (4 pages).
Eaton, Susan, "*Reversal of Fortune: Vertical and Horizontal Well Hybrid Offers Longer Field Life*," New Technology Magazine, Sep. 2002, pp. 30-31 (2 pages).
Mahony, James, "*A Shadow of Things to Come*," New Technology Magazine, Sep. 2002, pp. 28-29 (2 pages).
Documents Received from Third Party, Great Lakes Directional Drilling, Inc., Sep. 12, 2002, (12 pages).
Taylor, Robert W., et al. "*Multilateral Technologies Increase Operational Efficiencies in Middle East*," Oil and Gas Journal, Mar. 16, 1998, pp. 76-80 (5 pages).
Pasiczynk, Adam, "*Evolution Simplifies Multilateral Wells*," Directional Drilling, Jun. 2000, pp. 53-55 (3 pages).
Bell, Steven S. "*Multilateral System with Full Re-Entry Access Installed*," World Oil, Jun. 1, 1996, p. 29 (1 page).
Jackson, P., et al., "*Reducing Long Term Methane Emissions Resulting from Coal Mining*," Energy Convers. Mgmt, vol. 37, Nos. 6-8, 1996, pp. 801-806, (6 pages).
Breant, Pascal, "*Des Puits Branches, Chez Total : les puits multi drains*," Total XP-000846928, Exploration Production, Jan. 1999, 11 pages, including translation.
Chi, Weiguo, "*A feasible discussion on exploitation coalbed methane through Horizontal Network Drilling in China*," SPE 64709, Society of Petroleum Engineers (SPE International), Nov. 7, 2000, 4 pages.
B. Goktas et al., "*Performances of Openhole Completed and Cased Horizontal/Undulating Wells in Thin-Bedded, Tight Sand Gas Reservoirs*," SPE 65619, Society of Petroleum Engineers, Oct. 17-19, 2000 (7 pages).
Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).
Balbinski, E.F., "*Prediction of Offshore Viscous Oil Field Performance*," European Symposium on Improved Oil Recovery, Aug. 18-20, 1999, 10 pages.
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (PCT Rule 44.1) (3 pages) and International Search Report (4 pages) re International Application No. PCT/US 03/21626 mailed Nov. 6, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Notification of Transmittal of the International Search Report or the Declaration (PCT Rule 44.1) (3 pages) and International Search Report (5 pages) re International Application No. PCT/US 03/21627 mailed Nov. 5, 2003.
Notification of Transmittal of the International Search Report or the Declaration (PCT Rule 44.1) (3 pages) and International Search Report (4 pages) re International Application No. PCT/US 03/21628 mailed Nov. 4, 2003.
Notification of Transmittal of the International Search Report or the Declaration (PCT Rule 44.1) (3 pages) and International Search Report (5 pages) re International Application No. PCT/US 03/21750 mailed Dec. 5, 2003.
Notification of Transmittal of the International Search Report or the Declaration (PCT Rule 44.1) (3 pages) and International Search Report (3 pages) re International Application No. PCT/US 03/28137 mailed Dec. 19, 2003.
Notification of Transmittal of the International Search Report or the Declaration (PCT Rule 44.1) (3 pages) and International Search Report (5 pages) re International Application No. PCT/US 03/26124 mailed Feb. 4, 2004.
Notification of Transmittal of the International Search Report or the Declaration (PCT Rule 44.1) (3 pages) and International Search Report (6 pages) re International Application No. PCT/US 03/28138 mailed Feb. 9, 2004.
Notification of Transmittal of the International Search Report or the Declaration (PCT Rule 44.1) (3 pages) and International Search Report (6 pages) re International Application No. PCT/US-03/30126 mailed Feb. 27, 2004.
Smith, Maurice,"*Chasing Unconventional Gas Unconventionally*," CBM Gas Technology, New Technology Magazine, Oct./Nov. 2003, Title Page and pp. 1-4 (5 pages).
Gardes, Robert, "*A New Direction in Coalbed Methane and Shale Gas Recovery*," believed to have been first received at The Canadian Institute Coalbed Methane Symposium conference on Jun. 17, 2002, 7 pages.
Gardes, Robert, "*Under-Balanced Multi-Lateral Drilling for Unconventional Gas Recovery*," (to the best of Applicants' recollection, first received at The Unconventional Gas Revolution conference on Dec. 9, 2003, 30 pages.
Boyce, Richard G., "*High Resolution Selsmic Imaging Programs for Coalbed Methane Development*," (to the best of Applicants' recollection, first received at The Unconventional Gas Revolution conference on Dec. 10, 2003), 28 pages.
Mazzella, Mark, et al., "*Well Control Operations on a Multiwell Platform Blowout*," WorldOil.com—Online Magazine Article, vol. 22, Part I—pp.1-7, Jan. 2001, and Part II, Feb. 2001, pp. 1-13 (20 pages).
Vector Magnetics, LLC, Case History, California, May 1999, "*Successful Kill of a Surface Blowout*," 1999, pp. 1-12.
Cudd Pressure Control, Inc, "*Successful Well Control Operations—A Case Study: Surface and Subsurface Well Intervention on a Multi-Well Offshore Platform Blowout and Fire*," 2000, pp. 1-17, http://www.cuddwellcontrol.com/literature/successful/successful_well.htm.
Purl, R., et al., "*Damage to Coal Permeability During Hydraulic Fracturing*," SPE 21813, 1991, Title Page and pp. 109-115 (8 pages).
U.S. Dept. of Energy—Office of Fossil Energy, "*Multi-Seam Well Completion Technology: Implications for Powder River Basin Coalbed Methane Production*," Sep. 2003, pp. 1-100, A-1 through A-10 (123 pages).
U.S. Dept. of Energy—Office of Fossil Energy, "*Powder River Basin Coalbed Methane Development and Produced Water Management Study*," Nov. 2002, pp. 1-111, A-1 through A-14 (213 pages).
Fletcher, Sam, "*Anadarko Cuts Route Under Canadian River Gorge*," Oil & Gas Journal, Jan. 5, 2004, pp. 28-30, (3 pages).
Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 1997, 15 pages.
Kalinin, et al., Translation of Selected Pages from Ch. 4, Sections 4.2 (p. 135), 10.1 (p. 402), 10.4 (pp. 418-419), "*Drilling Inclined and Horizontal Well Bores*," Moscow, Nedra Publishers, 1997, 4 pages.
Arens, V. Zh., Translation of Selected Pages, "*Well-Drilling Recovery of Minerals*," Moscow, Nedra Publishers, 1986, 7 pages.
Jet Lavanway Exploration, "*Well Survey*," Key Energy Surveys, Nov. 2, 1997, 3 pages.
Precision Drilling, "*We Have Roots in Coal Bed Methane Drilling*," Technology Services Group, Published on or before Aug. 5, 2002, 1 page.
U.S. Dept. of Energy, "*New Breed of CBM/CMM Recovery Technology*," Jul. 2003, 1 page.
Ghiselin, Dick, "*Unconventional Vision Frees Gas Reserves*," Natural Gas Quarterly, Sep. 2003, 2 pages.
CBM Review, World Coal, "*US Drilling into Asia*," Jun. 2003, 4 pages.

Skrebowski, Chris, "*US Interest in North Korean Reserves*," Petroleum, Energy Institute, Jul. 2003, 4 pages.
Palmer, Ian D., et al., "*Coalbed Methane Well Completions and Stimulations*," Chapter 14, Hydrocarbons From Coal, American Association of Petroleum Geologists, 1993, pp. 303-339.
Field, T.W., "*Surface to In-seam Drilling—The Australian Experience*," Undated, 10 pages.
Drawings included in CBM well permit issued to CNX stamped Apr. 14, 2004 by the West Virginia Department of Environmenal Protection (5 pages).
Website of Mitchell Drilling Contractors, "*Services: Dymaxion—Surface to In-seam*," http://www.mitchell drilling.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thomson, et al., "*The Application of Medium Radius Directional Drilling for Coal Bed Methane Extraction*" Lucas Technical Paper, copyrighted 2003, 11 pages.
U.S. Department of Energy, DE-FC26-01NT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling*," Mar. 1999, 1 page.
Dasai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1-11.
Bybee, Karen, "*Advanced Openhole Multilaterals*," Horizontal Wells, Nov. 2002, pp. 41-42.
Bybee, Karen, "*A New Generation Multilateral System for the Troll Olje Field*," Multilateral/Extended Reach, Jul. 2002, 2 pages.
Emerson, A.B., et al., "*Moving Toward Simpler, Highly Functional Multilateral Completions*," Technical Note, Journal of Canadian Petroleum Technology, May 2002, vol. 41, No. 5, pp. 9-12 (4 pages).
Moritis, Guntis, "*Complex Well Geometries Boost Orinoco Heavy Oil Producing Rates*," XP-000969491, Oil & Gas Journal, Feb. 28, 2000, pp. 42-46.
Themig, Dan, "*Multilateral Thinking*," New Technology Magazine, Dec. 1999, pp. 24-25.
Smith, R.C., et al., "*The Lateral Tie-Back System: The Ability to Drill and Case Multiple Laterals*," IADC/SPE 27436, Society of Petroleum Engineers, 1994, pp. 55-64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1999, Title Page, Copyright Page, pp. 269-285.
Hanes, John, "*Outbursts in Leichhardt Colliery: Lessons Learned*," International Symposium-Cum-Workshop on Management and Control of High Gas Emissions and Outbursts in Underground Coal Mines, Wollongong, NSW, Australia, Mar. 20-24, 1995, Title page, pp. 445-449.
Williams, Ray, et al., "*Gas Reservoir Properties for Mine Gas Emission Assessment*," Bowen Basin Symposium 2000, pp. 325-333.
Brown, K., et al., "*New South Wales Coal Seam Methane Potential*," Petroleum Bulletin 2, Department of Mineral Resources, Discovery 2000, Mar. 1996, pp. i-viii, 1-96.
Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.
PowerPoint Presentation entitled, "Horizontal Coalbed Methane Wells," by Bob Stayton, Computalog Drilling Services, date is believed to have been in 2002 (39 pages).
Denney, Dennis, "*Drilling Maximum-Reservoir-Contact Wells in the Shaybah Field*," SPE 85307, pp. 60, 62-63, Oct. 20, 2003.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002. 4 pages.
Dreiling, Tim, McClelland, M.L. and Bilyeu, Brad, "Horizontal & High Angle Air Drilling in the San Juan Basin, New Mexico," Believed to be dated Apr. 1996, pp. 1-11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.
Fischer, Perry A., "What's Happening in Production," World Oil, Jun. 2001, p. 27.
Website of PTTC Network New vol. 7, 1st Quarter 2001, Table of Contents, http://www.pttc.org/../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—the U.S. Experience," Website, http://aapg.confex.com/aapg/cairo2002/techprogram/paper_66806.htm, printed Nov. 16, 2004 (1 page).
U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 (2 pages).
Zupanick, J., "Coalbed Methane Extraction," 28th Mineral Law Conference, Lexington, Kentucky, Oct. 16-17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).

Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).
Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).
The Official Newsletter of the Cooperative Research Centre for Mining Technology and Equipment, CMTE News 7, "Tight-Radius Drilling Clinches Award," Jun. 2001, 1 page.
Listing of 174 References received from Third Party on Feb. 16, 2005 (9 pages).
Gardes Directional Drilling, "Multiple Directional Wells From Single Borehole Developed," Reprinted from Jul. 1989 edition of Offshore, Copyright 1989 by PennWell Publishing Company (4 pages).
"Economic Justification and Modeling of Multilateral Wells," Economic Analysis, Harts's Petroleum Engineer International, 1997 (4 pages).
Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).
David C. Olyer and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).
P. Corlay, D. Bossie-Codreanu, J.C. Sabathier and E.R. Delamaide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).
C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991, (12 pages).
H.H. Fields, Stephen Krickovic, Albert Sainato, and M.G. Zabetakis, "Degasification of Virgin Pittsburgh Coalbed Through a Large Borehole," RI-7800, Bureau of Mines Report of Investigations/1973, United States Department of the Interior, 1973 (31 pages).
William P. Diamond, "Methane Control for Underground Coal Mines," IC-9395, Bureau of Mines Information Circular, United States Department of the Interior, 1994 (51 pages).
Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production," *WorldOil Magazine*, Feb. 2005, [printed from the internet on Mar. 7, 2005], http://www.worldoil.com/magazine/MAGAZINE_DETAIL.
asp?ART_ID=2507@MONTH_YEAR (3 pages).
Nazzal, Greg, "Moving Multilateral Systems to the Next Level, Strategic Acquisition Expands Weatherford's Capabilities," 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A Review of Horizontal Well Technology and Its Domestic Application," DOE/EIA-TR-0565, U.S. Department of Energy, Apr. 1993, 30 pages.
Santos, Helio, SPE, Impact Engineering Solutions and Jesus Olaya, Ecopetrol/ICP, "*No-Damage Drilling: How to Achieve this Challenging Goal*,?" SPE 77189, Copyright 2002, presented at the IADC/SPE Asia Pacific Drilling Technology, Jakarta, Indonesia, Sep. 9-11, 2002, 10 pages.
Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.
Franck Labenski, Paul Reid, SPE, and Helio Santos, SPE, Impact Solutions Group, "*Drilling Fluids Approaches for Contol of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.
Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.
Robert E. Snyder, "*Drilling Advances*," World Oil, Oct. 2003, 1 page.
U.S. Environmental Protection Agency, "*Directional Drilling Technology*," prepared for the EPA by Advanced Resources International under Contract 68-W-00-094, Coalbed Methane Outreach Program (CMOP), published Dec. 2002, Website: http://search.epa.gov/s97is.vts, printed Mar. 17, 2005, 13 pages.
"*Meridian Tests New Technology*," Western Oil World, Jun. 1990, Cover, Table of Contents and p. 13.
Clint Leazer and Michael R. Marquez, "*Short-Radius Drilling Expands Horizontal Well Applications*," Petroleum Engineer International, Apr. 1995, 6 pages.
Terry R. Logan, "*Horizontal Drainhole Drilling Techniques Used in Rocky Mountains Coal Seams*," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.
Daniel J. Brunner, Jeffrey J. Schwoebel, and Scott Thomson, "*Directional Drilling for Methane Drainage & Exploration in Advance of Mining*," Website: http://www.advminingtech.com.au/Paper4.htm, printed Apr. 6, 2005, Copyright 1999, Last modified Aug. 7, 2002 (8 pages).
Karen Bybee, highlights of paper SPE 84424, "*Coalbed-Methane Reservoir Simulation: An Evolving Science*," by T.L. Hower, JPT Online, Apr. 2004, Website: http://www.spe.org/spe/jpt/jsp/jptpapersynopsis/0,2439,1104_11038_2354946_2395832,00.
html, printed Apr. 14, 2005, 4 pages.
Kevin Meaney and Lincoln Paterson, "*Relative Permeability in Coal*," SPE 36986, Society of Petroleum Engineers, Copyright 1996, pp. 231-236.
Calendar of Event—Conference Agenda, Fifth Annual Unconventional Gas and Coalbed Methane Conference, Oct. 22-24, 2003, in Calgary Alberta, Website: http://www.csug.ca/cal/calc0301a.html, printed Mar. 17, 2005, 5 pages.
Tom Engler and Kent Perry, "*Creating a Roadmap for Unconventional Gas R&D*," Gas TIPS, Fall 2002, pp. 16-20.
CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.

Solutions From the Field, "*Coalbed Methane Resources in the Southeast*," Copyright 2004, Website: http://www.pttc.org/solutions/sol_2004/537.htm, printed Mar. 17, 2005, 7 pages.
Jeffrey R. Levine, Ph.D., "*Matrix Shrinkage Coefficient*," Undated, 3 pages.
G. Twombly, S.H. Stepanek, T.A. Moore, "*Coalbed Methane Potential in the Waikato Coalfield of New Zealand: A Comparison With Developed Basins in the United States*," 2004 New Zealand Petroleum Conference Proceedings, Mar. 7-10, 2004, pp. 1-6.
R.W. Cade, "*Horizontal Wells: Development and Applications," Presented at the Fifth International Symposium on Geophysics for Mineral*, Geotechnical and Environmental Applications, Oct. 24-28, 1993 in Tulsa, Oklahoma, Website: http://www.mgls.org/93Syn/Cade/cade.html, printed Mar. 17, 2005, 6 pages.
Solutions From the Field, "*Horizontal Drilling, A Technology Update for the Appalachian Basin*," Copyright 2004, Website: http://www.pttc.org/solutions/sol_2004/535.htm, printed Mar. 17, 2005, 6 pages.
R. Purl, J.C. Evanoff and M.L. Brugler, "*Measurement of Coal Clear Porosity and Relative Permeability Characteristics*," SPE 21491, Society of Petroleum Engineers, Copyright 1991, pp. 93-104.
Peter Jackson, "*Drilling Technologies for Underground Coal Gasification*," IMC Geophysics Ltd., International UCG Workshop—Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Search reprot (5 pages) and Written Opinion of the International Searching Authority (5 pages) re International Application No. PCT/US2004/036616 mailed Feb. 24, 2005.
Notification of Transmittal of International Preliminary Examination Report (1 page) and Internatioanl Preliminary Examination Report (3 pages) for International Application No. PCT/US03/13954 mailed Apr. 14, 2005.
Notification of Transmittal of Internatioanl Preliminary Examination Report (1 page) and International Preliminary Examination Reprot (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of International Preliminary Examination Report (1 page) and International Preliminary Examination Report (6 pages) mailed Apr. 2, 2001 and Written Opinion (7 pages) mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PC/US02/33128.
Notification of Transmittal of International Preliminary Examination Report (1 page) and International Preliminary Examination Report (3 pages mailed Apr. 22, 2004 and Written Opinion (6 pages) mailed sep. 4, 2003 for International Application No. PCT/US02/33128.
Notes on Consol Presentation (by P. Thakur) made at IOGA PA in Pittsburgh, Pennsylvania on May 22, 2002 (3 pages).
Notification of Transmittal of the International Preliminary Report of Patentability (1 page) and International Preliminary Report on Patentability (12 pages) mailed Jan. 9, 2006 for International Application No. PCT/US2004/036616.
Notification Concerning Transmittal of International Preliminary Report on Patentability (Chapter 1 of the Patent Cooperation Treaty) (1 page), International Preliminary Report on Patentability (1 page), and Written Opinion of the International Searching Authority (7 pages) mailed Dec. 22, 2005 for International Application No. PCT/US2004/017048.
European Search and Examination Report, completed Dec. 5, 2005 for Application No. EP 05020737, 5 pages.
P.C. Thakur and W.N. Poundstone, "*Horizontal Drilling Technology for Advance Degasification*," Society of Mining Engineers of AIME, Preprint No. 79-113, For presentation at the 1979 AIME Annual Meeting, New Orleans, Lousiana, Feb. 18-22, 1979, Engineering Societies Library stamp dated Feb. 5, 1980, 11 pages.
Notification Concerning Transmittal of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.
Wang Weiping, "*Trend of Drilling Technology Abroad*," Petroleum Drilling and Production Technology, 1995 (vol. 17), Issue 6, www.cnki.net, 8 pages, translation, original in Chinese.
Tver, David, *The Petroleum Dictionary*, 1980, p. 221 (3 pages).
Rennick, et al., "*Demonstration of Safety Plugging of Oil Wells Penetrating Appalachian Coal Mines*," Bureau of Mines Coal Mine Health and Safety Research Program, Technical Progress Report—56, U.S. Department of the Interior, Jul. 1972, 25 pages.
George N. Aul and Joseph Cervik, "*Grouting Horizontal Drainage Holes in Coalbeds*," RI 8375, Bureau of Mines Report of Investigations, U.S. Department of the Interior, 1979, 21 pages.
Paul J. Componation, et al., "*Cleaning Out, Sealing and Mining Through Wells Penetrating Areas of Active Coal Mines in Northern West Virginia*," MESA Information Report 1052, U.S. Department of the Interior, 1977, 26 pages.
George S. Rice, "*Notes on the Prevention of Dust and Gas Explosions in Coal Mines*," Technical Paper 56, Bureau of Mines, Department of the Interior, copyright 1913, 12 pages.
George S. Rice, et al., "*Oil and Gas Wells Through Workable Coal Beds*," Bulletin 65, Petroleum Technology 7, Bureau of Mines, Department of the Interior, copyright 1913, 54 pages.
Notification of Transmittal of the International Preliminary Report on Patentability (1 page) and International Preliminary Report on Patentability (8 pages) for International Application No. PCT/US2005/002162 mailed May 3, 2006.
D. Nathan Meehan, "*Technology Vital For Horizontal Well Success*," Oil & Gas Journal, Dec. 11, 1995, 8 pages.
B.A. Tarr, A.F. Kuckes and M.V. Ac, "*Use of New Ranging Tool to Position a Vertical Well Adjacent to a Horizontal Well*," SPE Drilling Engineering, Jun. 1992, 7 pages.
William J. McDonald, Ph.D., John H. Cohen, and C. Mel Hightower, "*New Lightweight Fluids for Underbalanced Drilling*," presented at the U.S. Department of Energy (DOE) 1999 Oil & Gas Conference, Dallas, Texas, Jun. 28-30, 1999, 10 pages.
Philip C. Crouse, "*Application and Needs for Advanced Multilateral Technologies and Strategies*," Website: www.netl.doe.gov/publications/proceedings/97/97ng/ng97_pdf/NG2-5.pdf; presented at the U.S. Department of Energy (DOE) 1997 Natural Gas Conference on Mar. 24-27, 1997 in Houston, Texas, 9 pages.
Dan Themig, "*Multi-Laterals Providing New Options*," The American Oil & Gas Reporter, V. 39, No. 7, Jul. 1996, 4 pages.
Daniel D. Gleltman, "*Integrated Underbalanced Directional Drilling System*," Interim Report for Period of Performance Oct. 1, 1995-Feb. 14, 1996, DOE FETC Contract DE-AC21-95MC31103, Mar. 1997, 23 pages.
J.D. Gallivan, N.R. Hewitt, M. Olsen, J.M. Peden, D. Tehrani and A.A.P. Tweedie, "*Quantifying the Benefits of Multi-Lateral Producing Wells*," SPE 30441, Society of Petroleum Engineers, Inc., Copyright 1995, 7 pages.
C.A. Ehlig-Economides, G.R. Mowat and C. Corbett, "*Techniques for Multibranch Well Trajectory Design in the Context of a Three-*

*Dimensional Reservoir Model*," SPE 35505, Society of Petroleum Engineers, Copyright 1996, 8 pages.
Stephen R. Dittoe, Albertus Retnanto, and Michael J. Economides, "*An Analysis of Reserves Enhancement in Petroleum Reservoirs with Horizontal and Multi-Lateral Wells*," SPE 37037, Society of Petroleum Engineers, Copyright 1996, 9 pages.
D.L. Boreck and M.T. Strever, "*Conservation of Methane from Colorado's Mined/Minable Coal Beds: A Feasibility Study*," Open-File Report 80-5, Colorado Geological Survey, Department of Natural Resources, Denver, Colorado, Oct. 1980, 101 pages.
B.G. kta and T. Ertekin, "*Implementation of a Local Grid Refinement Technique in Modeling Slanted, Undulating Horizontal and Multi-Lateral Wells*," SPE 56624, Society of Petroleum Engineers, Copyright 1999, 10 pages.
W.H. Leach Jr., "*New Technology for CBM Production*," Oil and Gas Investor, Opportunities in Coalbed Methane, Dec. 2002, 6 pages.
David Wagman, "*CBM Investors Keep Their Guard Up*," Oil and Gas Investor, Opportunities in Coalbed Methane, Dec. 2002, 5 pages.
Stephan D. Schwochow, "*CBM: Coming to a Basin Near You*," Oil and Gas Investor, Opportunities in Coalbed Methane, Dec. 2002, 7 pages.
"*White Paper: Guidebook on Coalbed Methane Drainage for Underground Coal Mines*," paper prepared under U.S. Environmental Protection Agency Cooperative Agreement No. CX824467-01-0 with The Pennsylvania State University by Jan M. Mutmansky, Apr. 1999, 50 pages.
M.G. Zabetakis, Maurice Deul, and M.L. Skow, "*Methane Control in United States Coal Mines—1972*," Information Circular 8600, United States Department of the Interior, Bureau of Mines Information Circular/1973, 26 pages.
B. Goktas, "*Comparative Analysis of the Production Characteristics of Cavity Completions and Hydraulic Fractures in Coalbed Methane Reservoirs*," Society of Petroleum Engineers, SPE 55600, Copyright 1999, 10 pages.
William P. Diamond and David C. Oyler, "*Drilling Long Horizontal Coalbed Methane Drainage Holes from a Directional Surface Borehole*," Society of Petroleum Engineers, SPE/DOE 8968, 1980, 6 pages.
Turgay Ertekin, Wonmo Sung, and Fred C. Schwerer, "*Production Performance Analysis of Horizontal Drainage Wells for the Degasification of Coal Seams*," Journal of Petroleum Technology, May 1988, 8 pages.
Patrick B. Tracy, "*Lateral Drilling Technology Tested on UCG Project*," IADC/SPE 17237, IADC/SPE Drilling Conference, Copyright 1988, 10 pages.
P.S. Sarkar and J.M. Rajtar, "*Transient Well Testing of Coalbed Methane Reservoirs With Horizontal Wells*," SPE 27681, Society of Petroleum Engineers, Copyright 1994, 9 pages.
R.A. Schraufnagel, D.G. Hill and R.A. McBane, "*Coalbed Methane—A Decade of Success*," SPE 28581, Society of Petroleum Engineers, Copyright 1994, 14 pages.
J.R. Kelafant, C.M. Boyer, and M.D. Zuber,"*Production Potential and Strategies for Coalbed Methane in the Central Appalachian Basin*," SPE 18550, Society of Petroleum Engineers, Copyright 1988, 8 pages.
Ian Palmer, John McLennan, and Mike Kutas, "*Completions and Stimulations for Coalbed Methane Wells*," SPE 30012, Society of Petroleum Engineers, Copyright 1995, 13 pages.
John E. Jochen and Bradley M. Robinson, "*Survey of Horizontal Gas Well Activity*," SPE 35639, Society of Petroleum Engineers, Copyright 1996, 5 pages.
R.G. Jeffrey, J.R. Enever, J.H. Wood, J.P. Connors, S.K. Choi, K.T.A. Meaney, D.A. Casey, and R.A. Koenig, "*A Stimulation and Production Experiment in a Vertical Coal Seam Gas Drainage Well*," SPE 36982, Society of Petroleum Engineers, Copyright 1996, 7 pages.
Matt C. Rowan and Michael J. Whims, "*Multilateral Well Enhances Gas Storage Deliverability*," Oil & Gas Journal, Dec. 25, 1995, 4 pages.
Dan Themig, "*Planning and Evaluation are Crucial to Multilateral Wells*," Petroleum Engineer International, Jan. 1996, 3 pages.
Larry Comeau, Randy Pustanyk, Ray Smith and Ian Gilles, "*Lateral Tie-Back System Increases Reservoir Exposure*," World Oil, Jul. 1995, 5 pages.
J. Smith, M.J. Economides and T.P. Frick, "*Reducing Economic Risk in Areally Anisotropic Formations With Multiple-Lateral Horizontal Wells*," SPIE 30647, Society of Petroleum Engineers, Copyright 1995, 14 pages.
Scott Thomson, Andrew Lukas, and Duncan McDonald, "*Maximising Coal Seam Methane Extraction through Advanced Drilling Technology*," Lucas, Technical Paper, Second Annual Australian Coal Seam & Mine Methane Conference, Feb. 19-20, 2003, 14 pages.
William P. Diamond and David C. Oyler, "*Directional Drilling for Coalbed Degasification in Advance of Mining*," Proceedings of the 2nd Annual Methane Recovery from Coalbeds Symposium, Apr. 18-20, 1979, 17 pages.
John L. Stalder, Gregory D. York, Robert J. Kopper, Carl M. Curtis and Tony L. Cole, and Jeffrey H. Copley, "*Multilateral-Horizontal Wells Increase Rate and Lower Cost Per Barrel in the Zuata Field*, Faja, Venezuela," SPE 69700, Society of Petroleum Engineers, Copyright 2001, 9 pages.
Brent Lowson, "*Multilateral-Well Planning*," Synopsis of SPE 39245, JPT, Jul. 1998, 4 pages.
A. Njaerheim, R. Rovde, E. Kvale, S.A. Kvamme, and H.M. Bjoerneli, "*Multilateral Well in Low-Productivity Zones*," Synopsis of SPE 39356, JPT, Jul. 1998, 4 pages.
S.W. Bokhari, A.J. Hatch, A. Kyei, and O.C. Werngren, "*Improved Recovery from Tight Gas Sands with Multilateral Drilling*," Synopsis of SPE 38629, JPT, Jul. 1998, 4 pages.
S.K. Vij, S.L. Narasaiah, Anup Walia, and Gyan Singh, "*Adopting Multilateral Technology*," Synopsis of SPE 39509, JPT, Jul. 1998, 3 pages.
William P. Diamond, David C. Oyler, and Herbet H. Fields, "*Directionally Controlled Drilling to Horizontally Intercept Selected Strata, Upper Freeport Coalbed*, Green County, PA," Bureau of Mines Report of Investigations/1977, RI 8231, 1977, 25 pages.
David C. Oyler, William P. Diamond, and Paul W. Jeran, "*Directional Drilling for Coalbed Degasification*," Program Goals and Progress in 1978, Bureau of Mines Report of Investigations/1979, RI 8380, 1979, 17 pages.
United States Department of the Interior, "*Methane Control Research: Summary of Results*, 1964-80," Bureau of Mines Bulletin, Bulletin 687, 1988, 188 pages.
EPA, "*Identifying Opportunities for Methane Recovery at U.S. Coal Mines: Profiles of Selected Gassy Underground Coal Mines 1997-2001*," EPA Publication EPA 430-K-04-003, Jul. 2004, 202 pages.
Marshall DeLuca, "*Multilateral Completions on the Verge of Mainstream*," Offshore, Apr. 1997, 2 pages.
Bob Williams, "*Operators Unlocking North Slope's Viscous Oil Commerciality*," Oil & Gas Journal, Aug. 6, 2001, 5 pages.
James P. Oberkircher, "*The Economic Viability of Multilateral Wells*," IADC/SPE 59202, Society of Petroleum Engineers, Copyright 2000, 10 pages.
Jim Oberkircher, "*What is the Future of Multilateral Technology?*," World Oil, Jun. 2001, 3 pages.
Rick Von Flatern, "*Operators Are Ready For More Sophisticated Multilateral Well Technology*," Petroleum Engineer International, Jan. 1996, 4 pages.
Kyle S. Graves, "*Multiple Horizontal Drainholes Can Improve Production*," Oil & Gas Journal, OGJ Special, Feb. 14, 1994, 5 pages.
Guntis, Moritis, "*Sincor Nears Upgrading, Plateau Production Phase*," Oil & Gas Journal, Oct. 29, 2001, 1 page.
Guntis Moritis, "*Smart, Intelligent Wells*," Oil & Gas Journal, Apr. 2, 2001, 6 pages.
Craig Coull, "*Intelligent Completion Provides Savings for Snorre TLP*," Oil & Gas Journal, Apr. 2, 2001, 2 pages.
D.T. Vo and M.V. Madden, "*Performance Evaluation of Trilateral Wells: Field Examples*," SPE 28376, Society of Petroleum Engineers, copyright 1994, 16 pages.
Dean E. Gaddy, "*Pioneering Work, Economic Factors Provide Insights Into Russian Drilling Technology*," Oil & Gas Journal, Jul. 6, 1998, 3 pages.
"*Optimal Multilateral-Well Design for a Heavy-Oil Reservoir*," Synopsis of SPE 37554 by D.W. Boardman, JPT, Jul. 1997, 3 pages.
"*Multilateral-Well Completion-System Advances*," Synopsis of SPE 39125 by J.R. Longbottom et al., JPT, Jul. 1997, 3 pages.

"*Optimal Multilateral/Multibranch Completions*," Synopsis of SPE 38033 by Hironori Sugiyama et al., JPT, Jul. 1997, 5 pages.
"*Multilateral Experiences: IDD El Shargi North Dome Field (QATAR)*," Synopsis of SPE 37675 by J.R. Scofield et al., JPT, Jul. 1997, 3 pages.
"*Moving Toward the 'Intelligent Well'*," Synopsis of SPE 39126 by Clark E. Robison, JPT, Jul. 1997, 3 pages.
"*Short-Radius Laterals: An Operators's Experience*," Synopsis of SPE 37493 by C. Ellis et al., JPT, Jul. 1997, 3 pages.
"*Analyzing a Multilateral-Well Failure*," Synopsis of SPE 38268 by A. Ray Brister, JPT, Jul. 1997, 3 pages.
"*A New Concept for Multibranch Technology*," Synopsis of SPE 39123 by Mark Stracke et al., JPT, Jul. 1997, 3 pages.
"*Classification Clarifies Multilateral Options*," Synopsis of SPE 38493 by C. Hogg, JPT, Jul. 1997, 3 pages.
"*Infill Development With Multilateral-Well Technology*," Synopsis of SPE 38030 by Sau-Wai Wong et al., JPT, Jul. 1997, 3 pages.
Brad Califf and Denny Kerr, "*UPRC Completes First Quad-Lateral Well*," Petroleum Engineer International, Sep. 1993, 4 pages.
Jack Winton, "*Use of Multi-lateral Wells to Access Marginal Reservoirs*," Offshore, Feb. 1999, 3 pages.
J.R. Salas, P.J. Clifford and D.P. Jenkins, "*Brief: Multilateral Well Performance Prediction*," JPT, Sep. 1996, 3 pages.
Mike R. Chambers, "*Multilateral Technology Gains Broader Acceptance*," Oil & Gas Journal, Nov. 23, 1998, 5 pages.
S. Ikeda, T. Takeuchi, and P.C. Crouse, "*An Investigative Study on Horizontal Well and Extended Reach Technologies With Reported Problem Areas and Operational Practice in North America and Europe*," IADC/SPE 35054, Society of Petroleum Engineers, Copyright 1996, 8 pages.
Greg Nazzal, "*Extended-Reach Wells Tap Outlying Reserves*," World Oil, Mar. 1993, 8 pages.
Bambang Tjondrodiputro, Harry Eddyarso and Kim Jones, "*How ARCO Drills High-Angle Wells Offshore Indonesia*," World Oil, Mar. 1993, 11 pages.
S. Hovda, et al., "*Worlds's First Application of a Multilateral System Combining a Cased and Cemented Junction With Fullbore Access to Both Laterals*," SPE 36488, Society of Petroleum Engineers, Copyright 1996, 15 pages.
Robert A. Gardes, "*Micro-annulus Under-balanced Drilling of Multilateral Wells*," Offshore, May 1996, 4 pages.
Brent Lowson, "*Phillips Multilateral Features Several Firsts for North Sea*," Offshore, Feb. 1997, 2 pages.
J.R. Scofield, B. Laney and P. Woodard, "*Field Experience With Multi-Laterals in the Idd El Shargi North Dome Field (Qatar)*," SPE/IADC 37675, Society of Petroleum Engineers, Copyright 1997, 11 pages.
Jeremy Beckman, "*Coiled Tubing, Reamer Shoes Push Through Barriers in North Sea Wells*," Offshore, Feb. 1997, 1 page.
C.H. Fleming, "*Comparing Performance of Horizontal Versus Vertical Wells*," World Oil, Mar. 1993, 7 pages.
Larry A. Cress and Stephen W. Miller, "*Dual Horizontal Extension Drilled Using Retrievable Whipstock*," World Oil, Jun. 1993, 9 pages.
Guntis Moritis, "*Heavy Oil Expansions Gather Momentum Worldwide*," Oil & Gas Journal, Aug. 14, 1995, 6 pages.
K.W. Hart and L.V. Jankowski, "*The Application of Slant Hole Drilling in Development of Shallow Heavy Oil Deposits*," The Journal of Canadian Petroleum Technology, Jan.-Feb. 1984, Montreal, 6 pages.
Jeff Smith and Bob Edwards, "*Slant Rigs Offer Big Payoffs in Shallow Drilling*," Oil & Gas Journal, Mar. 30, 1992, 3 pages.
Ravil Gabdullinovich Salikhov, Evgeny Fedyorovich Dubrovin, and Vladimir Vladimirovich Sledkov, "*Cluster and Dual-Lateral Drilling Technologies Optimize Russian Well Production*," Oil & Gas Journal, Nov. 24, 1997, 7 pages.
Dean E. Gaddy, "*Inland Barge to Allow Cluster Drilling in Nigeria*," Oil & Gas Journal, Aug. 30, 1999, 7 pages.
Cliff Hogg, "*Comparison of Multilateral Completion Scenarios and Their Application*," SPE 38493, Society of Petroleum Engineers, Copyright 1997, 11 pages.
S.W. Bokhari, A.J. Hatch, A. Kyei and O.C. Wemgren, "*Improved Recoveries in the Pickerill Field from Multilateral Drilling into Tight Gas Sands*," SPE 38629, Society of Petroleum Engineers, Copyright 1997, 15 pages.
J.R. Longbottom, Dana Dale, Kevin Waddell, Scott Bruha, and John Roberts, "*Development, Testing, and Field Case Histories of Multilateral Well Completion Systems*," SPE 36994, Society of Petroleum Engineers, Copyright 1996, 16 pages.
E.J. Antczak, D.G.L. Smith, D.L. Roberts, Brent Lowson, and Robert Norris, "*Implementation of an Advanced Multi-Lateral System With Coiled Tubing Accessibility*," SPE/IADC 37673, Society of Petroleum Engineers, Copyright 1997, 9 pages.
H. Azoba, O. Akinmoladun, H. Rothenhofer, D. Kent and N. Nawfal, "*World Record Dual- and Tri-lateral Wells*," SPE/IADC 39240, Society of Petroleum Engineers, Copyright 1997, 6 pages.
R.W. Taylor and Rick Russell, "*Case Histories: Drilling and Completing Multilateral Horizontal Wells in the Middle East*," SPE/IADC 39243, Society of Petroleum Engineers, Copyright 1997, 14 pages.
D.K. Triolo and R.A. Mathes, "*Review of a Multi-Lateral Drilling and Stimulation Program*," SPE/IADC 39242, copyright 1997, Society of Petroleum Engineers, 13 pages.
John H. Perry, Leonard J. Prosser, Jr., Joseph Cervik, "*Methane Drainage from the Mary Lee Coalbed, Alabama, Using Horizontal Drilling Techniques*," SPE/DOE 8967, Society of Petroleum Engineers, May 18, 1980, 6 pages.
Gerald L. Finfinger, Leonard J. Prosser, and Joseph Cervik, "*Influence of Coalbed Characteristics and Geology on Methane Drainage*," SPE/DOE 8964, Society of Petroleum Engineers, May 18, 1980, 6 pages.
Hilmer Von Schonfeldt, B. Rao Pothini, George N. Aul and Roger L. Henderson, "*Production and Utilization of Coalbed Methane Gas in Island Creek Coal Company Mines*," SPE/DOE 10817, Society of Petroleum Engineers, May 16, 1982, 10 pages.
Joseph Cervik, H.H. Fields, and G.N. Aul, "*Rotary Drilling Holes in Coalbeds for Degasification*," RI 8097, Bureau of Mines Reporting of Investigations, 1975, 26 pages.
D.G. Masszi and A.A. Kahil, "*Coal Demethanation Principles and Field Experience*" The Journal of Canadian Petroleum Technology, Jul. -Aug. 1982, 4 pages.
Tobias W. Goodman, Joseph Cervik, and George N. Aul, "*Degasifications Study From and Air Shaft in the Beckley Coalbed*," RI 8675, Bureau of Mines Report of Investigations, 1982, 23 pages.
P.C. Thakur and H.D. Dahl, "*Horizontal Drilling—A Tool for Improved Productivity*," Mining Engineering, Mar. 1982, 3 pages.
P.C. Thakur and J.G. Davis II, "*How to Plan for Methane Control in Underground Coal Mines*," Mining Engineering, Oct. 1977, 5 pages.
A.B. Yost II and B.H. Javins, "*Overview of Appalachian Basin High-Angle and Horizontal Air and Mud Drilling*," SPE 23445, Society of Petroleum Engineers, Oct. 22, 1991, 14 pages.
Pramod C. Thakur, "*Methane Flow in the Pittsburgh Coal Seam*," Third International Mine Ventilation Congress, England, U.K., Jun. 13-19, 1984, 17 pages.
Chapter 10 by Pramod C. Thakur, "*Methane Control for Longwall Gobs*," Longwall-Shortwall Mining, State Of The Art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-Measure Boreholes on a Retreat Longwall Face*," Preprint No. 83-398, Society of Mining Engineers of AIME, for presentation at the SME-AIME Fall Meeting and Exhibit, Salt Lake City, Utah, Oct. 19-21, 1983, 14 pages.
Warren F. Dobson and Daniel R. Seelye, "*Mining Technology Assists Oil Recovery From Wyoming Field*," SPE 9418, Soceity of Petroleum Engineers of AIME, Copyright 1980, 7 pages.
T.L. Logan, J.J. Schwoebel and D.M. Horner, "*Application of Horizontal Drainhole Drilling Technology for Coalbed Methane Recovery*," SPE/DOE 16409, Society of Petroleum Engineers/U.S. Department of Energy, Copyright 1997, 12 pages.
Samuel O. Osisanya and Robert F. Schaffitzel, "*A Review of Horizontal Drilling and Completion Techniques for Recovery of Coalbed Methane*," SPE 37131, Society of Petroleum Engineers, Copyright 1996, 13 pages.
S.D. Joshi, "*Review of Horizontal Well and Drainhole Technology*," SPE 16868, Society of Petroleum Engineers, Copyright 1987, 17 pages.

R. Bitto, A.B. Henderson and L. Broussard, "*Recent Case Histories of New Well Applications for Horizontal Drilling*," SPE 21262, Society of Petroleum Engineers, Copyright 1990, 12 pages.
M.R. Konopczynski, John Hughes and J.E. Best, "*A Novel Approach to Initiating Multi-Lateral Horizontal Wells*," SPE/IADC 29385, Society of Petroleum Engineers, Copyright 1996, 11 pages.
Kelly Falk and Craig McDonald, "*An Overview of Underbalanced Drilling Applications in Canada*," SPE 30129, Society of Petroleum Engineers, Copyright 1995, 9 pages.
"*Evolution Toward Simpler, Less Risky Multilateral Wells*," World Oil, prepared from paper SPE/IADC 67825 by Adam Pasicznyk, Jun. 2001, 8 pages.
"*How Multilateral Boreholes Impact Ultimate Recovery Strategies*," Offshore, Jul. 1997, 6 pages.
"*Trilateral Horizontal Wells Add 10 Million bbl for Unocal*," Offshore, Dec. 1993, 2 pages.
Nicholas P. Chironis, "*New Borehole Techniques Offer Hope for Gassy Mines*," Coal Age, Jan. 1973, 4 pages.
A. Retnanto, T.P. Frick, C.W. Brand, and M.J. Economides, "*Optimal Configurations of Multiple-Lateral Horizontal Wells*," SPE 35712, Society of Petroleum Engineers, Copyright 1996, 8 pages.
T.L. Logan "*Horizontal Drainhole Drilling Techniques Used for Coal Seam Resource Exploitation*," SPE 18254, Society of Petroleum Engineers, Copyright 1988, 13 pages.
David Hill, Eric Neme, Christine Enlig-Economides and Miguel Mollinedo, "*Reentry Drilling Gives New Life to Aging Fields*," Oilfield Review, Autumn 1996, 14 pages.
R.L. Thoms and R.M. Gehle, "*Feasibility of Controlled Solution Mining From Horizontal Wells*," Solution Mining Research Institute, Oct. 24-27, 1993, 8 pages.
"*World's First Trilateral Horizontal Wells on Stream*," Oil & Gas Journal, Nov. 29, 1993, 2 pages.
Margaret A. Adams, James L. Hewitt and Rodney D. Malone, "*Coalbed Methane Potential of the Appalachians*," SPE/DOE 10802, Society of Petroleum Engineers, Copyright 1982, 10 pages.
F.C. Schwerer and A.M. Pavone, "*Effect of Pressure-Dependent Permeability on Well-Test Analyses and Long-Term Production of Methane From Coal Seams*," SPE/DOE/GRI 12857, Society of Petroleum Engineers, Copyright 1984, 10 pages.
Stephen Krickovic and J.D. Kalasky, "*Methane Emission Rate Study in a Deep Pocahontas No. 3 Coalbed Mine in Conjunction With Drilling Degasification Holes in the Coalbed*," RI-7703, Bureau of Mines Report of Investigations/1972, United States Department of the Interior, 1972, 15 pages.
H.H. Fields, Joseph Cervik, and T.W. Goodman, "*Degasification and Production of Natural Gas From an Air Shaft in the Pittsburgh Coalbed*," RI-8173, Bureau of Mines Report of Investigations/1976, United States Department of the Interior, 1976, 28 pages.
Gerald L. Finfinger and Joseph Cervik, "*Drainage of Methane From the Overlying Pocahontas No. 4 Coalbed From Workings in the Pocahontas No. 3 Coalbed*", RI-8359, Bureau of Mines Report of Investigations/1979, United States Department of the Interior, 1979, 19 pages.
Gerald L. Finfinger and Joseph Cervik, "*Review of Horizontal Drilling Technology for Methane Drainage From U.S. Coalbeds*," IC-8829, Bureau of Mines Information Circular/1980, United States Department of the Interior, 1980, 24 pages.
Andre P. Jourdan and Guy A. Baron, "*Elf Drills 1,000 + Ft Horizontally*," Petroleum Engineer International, Sep. 1981, 4 pages.
P.F. Conti, "*Controlled Horizontal Drilling*," SPE/IADC 18708, Society of Petroleum Engineers, Copyright 1989, 6 pages.
Armando R. Navarro, "*Innovative Techniques Cut Costs in Wetlands Drilling*," Oil & Gas Journal, Oct. 14, 1991, 4 pages.
Victor M. Luhowy and Peter D. Sametz, "*Horizontal Wells Prove Effective in Canadian Heavy-Oil Field*," Oil & Gas Journal, Jun. 28, 1993, 6 pages.
D. Lane Becker, "*Project Management Improved Multiwell Shallow Gas Development*," Oil & Gas Journal, Oct. 16, 1995, 5 pages.
Mike R. Chambers, "*Junction Design Based on Operational Requirements*," Oil & Gas Journal, Dec. 7, 1998, 7 pages.
A.J. Branch, et al., "*Remote Real-Time Monitoring Improves Orinoco Drilling Efficiency*," Oil & Gas Journal, May 28, 2001, 6 pages.
D. Keith Murray, "*Deep Coals Hold Big Part of Resource*," The American Oil& Gas Reporter, May 2002, 8 pages.
Nestor Rivera, et al., "*Multilateral, Intelligent Well Completion Benefits Explored*," Oil & Gas Journal, Apr. 14, 2003, 10 pages.
Handbook on Coal Bed Methane Produced Water: Management and Beneficial Use Alternatives, prepared by ALL Consulting, Jul. 2003, 321 pages.
Nikola Maricic, "*Parametric and Predictive Analysis of Horizontal Well Configurations for Coalbed Methane Reservoirs in Appalachian Basin*," Thesis, West Virginia University, Department of Petroleum and Natural Gas Engineering, 2004, 162 pages.
Nikola Maricic, Shahab D. Mohaghegh, and Emre Artun, "*A Parametric Study on the Benefits of Drilling Horizontal and Multilateral Wells in Coalbed Methane Reservoirs*," SPE 96018, Society of Petroleum Engineers, Copyright 2005, 8 pages.
D.P. Schlick and J.W. Stevenson, "*Methane Degasification Experience at Jim Walters's*," Proceedings of the Twelfth Annual Institute on Coal Mining Health, Safety and Research, Aug. 25-27, 1981, 9 pages.
P.C. Thakur, "*Optimum Methane Drainage in Gassy Coal Mines*," 2003 SME Annual Meeting, copyright 2003 by SME, 4 pages.
Global Methane and the Coal Industry: A Two-Part Report on Methane Emissions from the Coal Industry and Coalbed Methane Recovery and Use, Coal Industry Advisory Board, International Energy Agency, copyright 1994, 72 pages.
Paul F. Conti and Michael Schumacher, "Solution Mining in the Nineties," Presented at the Fall 1991 meeting of the Solution Mining Research Institute, Oct. 27-30, 1991, 11 pages.
Notification of Transmittal of the International Preliminary Report on Patentability (1 page), International Preliminary Report on Patentability (7 pages) and Amended Sheets (9 pages) for International Application No. PCT/US2004/012029 mailed Aug. 11, 2005.
Notification Concerning Transmittal of International Preliminary Report on Patentability (1 page), International Preliminary Report on Patentability (1 page), and Written Opinion (5 pages) for International Application No. PCT/US2005/005289 mailed Sep. 8, 2006.
Invitation to Pay Additional Fees (2 pages) and Annex to Form PCT/ISA/206 Communication Relating to the Results of the Partial International Search (3 pages) for International Application No. PCT/US2006/021057 mailed Sep. 11, 2006.
Kalinin, D.G., et al., Translation of Selected Pages, "boring Direction and Horizontal Wells," Moscow, "Nedra", 1997, p. 11-12, 148-152 (15 pages).
Platt, "Method and System for Lining Multilateral Wells," U.S. Appl. No. 10/772,841, Feb. 5, 2004 (29 pages).
Evaluation of Coalbed Methane Well Types in the San Juan Basin, prepared by Malkewicz Hueni Associates, Inc. for The Bureau of Land Management, Mar. 2004, 23 pages.
Robert William Chase, "*Degasification of Coal Seams Via Vertical Boreholes: A Field and Computer Simulation Study*," Thesis in Petroleum and Natural Gas Engineering, Mar. 1980, 174 pages.
L.Z. Shuck and J. Pasini III, "In Situ Gasification of Eastern Coals," presented at the proceedings of the Coal Processing and Conversion Symposium, Jun. 1-3, 1976, Morgantown, West Virginia, 16 pages.
Terry L. Logan, "Application of Medium Radius Horizontal Drainhole Drilling Technology for Underground Coal Gasification," presented at 13th Annual Underground Coal Gasification Symposium, Aug. 24-26, 1987, Laramie, Wyoming, 10 pages.
S.R. Lindblom and V.E. Smith, "Rocky Mountain 1 Underground Coal Gasification Test," Hanna, Wyoming, Groundwater Evaluation, DOE Grant No. DE-FG21-88MC25038, Final Report, Jun. 10, 1988-Jun. 30, 1993, 5 pages.
Coal-Bed Methane: Potential and Concerns, U.S. Department of the Interior, U.S. Geological Survey, USGS Fact Sheet FS-123-00, Oct. 2000, 2 pages.
Horizontal and Multilateral Wells, Society of Petroleum Engineers, website: http://www.spe.org/spe/jsp/basic_pf/0,,1104_1714_1003974,00.html, printed Dec. 27, 2006, 5 pages.
Notification of Transmittal of the International Search Report and the Written Opinion of the International Searching Authority, or the Declaration (3 pages), International Search Report (7 pages), and Written Opinion of the International Searching Authority (7 pages) for International Application No. PCT/US2006/021057 dated January 4, 2007.

I.D. Palmer, M.J. Mavor, J.L. Spitler and R.F. Volz, "*Openhole Cavity Completions in Coalbed Methane Wells in the San Juan Basin*," Journal of Petroleum Technology, vol. 45, No. 11, Nov. 1993, 11 pages.

V.S. Orlov, et al., "*Methods for Simultaneous Segregated Production from Multiple Formations Using Single Well*," Series Petroleum Engineering, Moscow, Aurdiomeogi, 1976, translated pages 6-11, 28-29 and 36-37, 15 pages.

Kalinin A.G. et al., "*Boring of Slanted and Horizontal Well Bores*," Moskva, Nedra, 1997, pp. 453-458, Sections 11.2, 11.2.2, and 11.2.3, 10 pages.

Notification Concerning Transmittal of International Preliminary Report on Patentability (1 page), International Preliminary Report on Patentability (1 page), and Written Opinion (5 pages) for International Application No. PCT/US2005/005289 mailed Sep. 8, 2006.

Notifiction of Transmittal of the International Preliminary Report on Patentability (1 page) and International Preliminary Report on Patentability (10 pages) for International Application No. PCT/US2006/021057 mailed Jul. 9, 2007.

William P. Diamond and David C. Oyler, "Effects of Stimulation Treatments on Coalbeds and Surrounding Strata: Evidence From Underground Observations," RI 9083, Bureau of Mines Report of Investigations, 1987 (53 pages).

W.P. Diamond and D.C. Oyler, "Recent Underground Observations of Intercepted Hydraulic Stimulations in Coalbed Methane Drainage Wells," Preprint No. 85-332, Society of Mining Engineers of AIME, SME-AIME Fall Meeting, Oct. 16-18, 1985 (12 pages).

William P. Diamond, "Underground Observations of Mined-Through Stimulation Treatments of Coalbeds," Methane from Coal Seams Technology, Jun. 1987 (11 pages).

W.P. Diamond, "Characterization of Fracture Geometry and Roof Penetrations Associated with Stimulation Treatments in Coalbeds," 1987 Coalbed Methane Symposium, Nov. 16-19, 1987 (11 pages).

C.M. McCulloch, Maurice Deul and P.W. Jeran, "Cleat in Bituminous Coalbeds," RI 7910, Bureau of Mines Report of Investigations, 1974 (28 pages).

B.E. Law, "The Relationship Between Coal Rank and Cleat Spacing: Implications for the Prediction of Permeability in Coal," Proceedings of the 1993 International Coalbed Methane Symposium, May 17-21, 1993 (7 pages).

C.T. Montgomery and R.E. Steanson, "Proppant Selection: The Key to Successful Fracture Stimulation," Journal of Petroleum Technology, Dec. 1985 (10 pages).

R.W. Veatch, Jr., "Overview of Current Hydraulic Fracturing Design and Treatment Technology—Part 2," Journal of Petroleum Technology, May 1983 (12 pages).

David D. Cramer, "The Unique Aspects of Fracturing Western U.S. Coalbeds," Journal of Petroleum Technology, Oct. 1992 (8 pages).

S.A. Holditch, J.W. Ely, R.H. Carter, and M.E. Semmelbeck, Coal Seam Stimulation Manual, Gas Research Institute, Contract No. 5087-214-1469, Apr. 1990 (265 pages).

Jack E. Nolde, "Coalbed Methane in Virginia," Virginia Minerals, Virginia Division of Mineral Resources, vol. 41, Feb. 1995 (7 pages).

C.H. Elder and Maurice Deul,"Degasification of the Mary Lee Coalbed Near Oak Grove, Jefferson County, Ala., by Vertical Borehole in Advance of Mining," RI 7968, U.S. Bureau of Mines, 1974 (23 pages).

Maureen Lorenzetti, "Policymakers eye frac regulation to protect groundwater," Oil & Gas Journal, Sep. 10, 2001, page 40 (1 page).

Peter F. Steidl, "Foam Stimulation To Enhance Production From Degasification Wells in the Pittsburgh Coalbed," RI 8286, Bureau of Mines Report of Investigations, 1978 (11 pages).

David G. Hill, "Contribution of Unconventional Gas to U.S. Supply Continues to Grow," Gas Research Institute Gas TIPS, Fall 2001 (6 pages).

Vello A. Kuuskraa and Charles F. Brandenburg, "Coalbed Methane Sparks a New Energy Industry," Oil & Gas Journal, Week of Oct. 9, 1989 (8 pages).

Walter B. Ayers Jr. and Bruce S. Kelso, "Knowledge of Methane Potential for Coalbed Resources Grows, But Needs More Study," Oil & Gas Journal, Oct. 23, 1989 (6 pages).

Journal E. McElhiney, Robert A. Koenig and Richard A. Schraufnagel, "Evaluation of Coalbed-Methane Reserves Involves Different Techniques," Oil & Gas Journal, Week Of Oct. 9, 1989 (8 pages).

Steven W. Lambert, Stanley L. Graves and Arfon H. Jones, "Warrior Basin Drilling, Stimulation Covered," Oil & Gas Journal, Week of Oct. 9, 1989 (7 pages).

Steven W. Lambert and Stanley L. Graves, "Production Strategy Developed," Oil & Gas Journal, Week of Oct. 9, 1989 (4 pages).

Terry L. Logan, Western Basins Dictate Varied Operations, Oil & Gas Journal, Week of Oct. 9, 1989 (7 pages).

Vello A. Kuuskra, Charles M. Boyer II, and Richard A. McBane, "Steps to Assess Resource Economics Covered," Oil & Gas Journal, Week of Oct. 9, 1989 (6 pages).

Richard A. Counts, "Ownership Questions Can Stymie Development of Coalbed Methane," Oil & Gas Journal, Week of Oct. 9, 1989 (6 pages).

Richard A. Schraufnagel, Richard A. McBane and Vello A. Kuuskraa, "Coalbed Methane Development Faces Technology Gaps," Oil & Gas Journal, Week of Oct. 9, 1989 (7 pages.

"US Coalbed Methane Resource Estimates, Issues Aired," Oil & Gas Journal, Sep. 24, 2001 (2 pages).

Dr. Charles R. Nelson, "Coalbed Methane Potential of the U.S. Rocky Mountain Region," Gas TIPS, Fall 2000 (9 pages).

Dr. Charles R. Nelson, "Changing Perceptions Regarding the Size and Production Potential of Coalbed Methane Resources," Gas TIPS, Summer 1999 (9 pages).

Ala. Coalbed Methane Production Hits Record, Coal Age, May 1998 (1 page).

Charles M. Boyer II, "Introduction," Gas Research Institute, Methane From Coal Seams Technology, Aug. 1993 (4 pages).

P.F. Steidl, "Evaluation of Induced Fractures Intercepted by Mining," Proceedings of the 1993 International Coalbed Methane Symposium, May 17-21, 1993 (12 pages).

W.P. Diamond, W.R. Bodden III, M.D. Zuber and R.A. Schraufnagel, "Measuring the Extent of Coalbed Gas Drainage After 10 Years of Production at the Oak Grove Pattern, Alabama," Proceedings of the 1989 Coalbed Methane Symposium, Apr. 17-20, 1989 (10 pages).

W.M Merritts, W.N. Poundstone and B.A. Light, "Removing Methane (Degasification) From the Pittsburgh Coalbed in Northern West Virginia," Bureau of Mines RI 5977, 1962 (46 pages.

M.L. Skow, Ann G. Kim and Maurice Deul, "Creating a Safer Environment in U.S. Coal Mines," U.S. Bureau of Mines Impact Report, 1980 (56 pages).

Stephen W. Lambert, Michael A. Trevits, and Peter F. Steidl, "Vertical Borehole Design and Completion Practices Used to Remove Methane Gas From Mineable Coalbeds," U.S. Dept. of Energy, 1980 (173 pages).

M.A. Trevits, S.W. Lambert, P.F. Steidl and C.H. Elder, "Methane Drainage Through Small-Diameter Vertical Boreholes," Chapter 9 in U.S. Bureau of Mines Bulletin B687 entitled Methane Control Research: Summary of Results, 1964-80, 1988 (25 pages).

C.M. Boyer II and S.R. Reeves, "A Strategy for Coalbed Methane Production Development Part III: Production Operations," Proceedings of the 1989 Coalbed Methane Symposium, Apr. 17-20, 1989 (5 pages).

R.A. Mills and J.W. Stevenson, "History of Methane Drainage at Jim Walter Resources, Inc.," Proceedings of the 1991 Coalbed Methane Symposium, May 13-16, 1991 (9 pages).

Richard A. Schraufnagel, "Coalbed Methane Production," Chapter 15 of Hydrocarbons from Coal, American Association of Petroleum Geologists, 1993 (21 pages).

Curtis H. Elder, "Effects of Hydraulic Stimulation on Coalbeds and Associated Strata," Bureau of Mines RI 8260, 1977 (25 pages).

A Guide to Coalbed Methane Reservoir Engineering, published by Gas Research Institute, GRI-94/0397, pp. 2.11-2.12, 1996 (3 pages).

Well Performance Manual, Schlumberger, pp. 3-1 and 3-2, Aug. 1993 (4 pages).

Michael Zuber, "Coalbed Methane Engineering Methods," The Society of Petroleum Engineers, Oct. 2006 (161 pages).

James V. Mahoney, P.B. Stubbs, F.C. Schwerer III and F.X. Dobscha, "Effects of a No-Proppant Foam Stimulation Treatment on a Coal-Seam Degasification Borehole," Journal of Petroleum Technology, Nov. 1981 (9 pages).
S.J. Jeu, T.L. Logan and R.A. McBane, "Exploitation of Deeply Buried Coalbed Methane Using Different Hydraulic Fracturing Techniques in the Piceance Basin, Colorado and San Juan Basin New Mexico," Society of Petroleum Engineers, SPE 18253, copyright 1988 (11 pages).
Stephen E. Laubach, Carol M. Tremain and Walter B. Ayers, Jr., "Coal Fracture Studies: Guides for Coalbed Methane Exploration and Development," Journal of Coal Quality, vol. 10, No. 3, Jul.-Sep. 1991 (8 pages).
Dreiling, Tim, McClelland, M.L., and Bilyeu, Brad, "Horizontal and High Angle Air Drilling in the San Juan Basin, New Mexico," The Brief, published by Amoco and Chevron by Murphy Publishing, Inc., vol. 2, Issue 6, No. 54, Jun. 1996 (9 pages).
Communication of Partial European Search Report (1 page), Partial European Search Report (2 pages) , Lack of Unity of Invention Sheet B (2 pages) and Annex to the European Search Report (1 page) for Application No. EP 07 02 1409 dated Aug. 6, 2008.
B. Campbell, "*Directional Driller Discovers Future in Technology*," The American Oil & Gas Reporter, Jul. 1991 (4 pages).
"*Economic Justification and Modeling of Multilateral Wells*," in "Multilateral Technology: Taking Horizontal Wells to the Next Level" — a supplement to Hart's Petroleum Engineer, International, 1997 (5 pages).
R. Gardes, "*New Radial Drilling Technology Applied to Recovering Cores*," The American Oil & Gas Reporter, Apr. 1993 (5 pages).
Gardes Energy Services, Inc., Map of Drilled Well Locations (1 page).
"*Gardes Drilling redefines improved recovery*," Improved Recovery Week, vol. 1, No. 21, Jul. 1992 (3 pages).
R. Gardes, "*Micro-Annulus Underbalanced Drilling of Multilaterals*," 4th Annual North American Conference on Coiled Tubing, Feb. 5-6, 1996 (23 pages).
R. Gardes, "*The Evolution of Horizontal Multi-Lateral Underbalanced Drilling Technology*," Society of Independent Professional Earth Scientists Newsletter, vol. 38, Aug. 2000 (3 pages).
R. Gardes, *Underbalanced Drilling of Multilateral Horizontal Wells*, 8th Annual International Conference on Horizontal Well Technologies & Applications, Sep. 9-11, 1996 (7 pages).
"*Lafayette firm set to do business with Soviet Union*," Advertiser, Lafayette, La, Aug. 1990 (1 page).
L. LeBlanc, "*Beyond extended-read, horizontal drilling?*," Drilling & Production, May 1992 (1 page).
"*Local firm signs contract to develop Soviet fields*," The Daily Advertiser, Dec. (1 page).
"*History Repeats Itself: Multilateral Technology Development Parallels That of Horizontal Wells*," in "Multilateral Technology: Taking Horizontal Wells to the Next Level" — a supplement to Hart's Petroleum Engineer International, (5 pages).
"*New Enabling Technologies Spur Multilateral Use*," in "Multilateral Technology: Taking Horizontal Wells-to the Next Level" — a supplement to Hart's Petroleum Engineer International, (5 pages).
"*New tools, techniques reduce high-angle drilling costs*," Offshore, Nov. 1989 (3 pages).
R. Gardes, "*Micro-annulus under-balanced drilling of multilateral wells*," Offshore, May 1996 (4 pages).
"*Multiple directional wells from single borehole developed*," Offshore, reprint from Jul. 1989 (4 pages).
"*Soviet joint venture pace continues to sizzle*," Oil & Gas Journal, week of Jun. 25, 1990 (3 pages).
"*Operators Team Up to Climb Learning Curve Together*," in "Multilateral Technology: Taking Horizontal Wells to the Next Level" — a supplement to Hart's Petroleum Engineer International (4 pages).
"*Radial Coring Reduces Sample Contamination, Evaluates Old Wells*," Hart's Petroleum Engineer International, Jun. 1994 (4 pages).
"*The Fate of Award Winners is a Credit to Their Judges*," Hart's Petroleum Engineer International, Apr. 1996 (3 pages).
S. R. Reeves and S. H. Stevens, "$CO_2$ *Sequestration*," World Coal, Dec. 2000 (4 pages).
"*Successful Completions Raise Operators' Confidence*," in "Multilateral Technology: Taking Horizontal Wells to the Next Level" — a supplement to Hart's Petroleum Engineer International (5 pages).

* cited by examiner

CAVITY WELL SYSTEM

TECHNICAL FIELD

The present invention relates generally to accessing subterranean zones.

BACKGROUND

Subterranean deposits of coal contain substantial quantities of entrained methane gas. Production of this gas is desirable both when it can be produced in useful quantities as a natural resource as well as when it is present in areas where mining of the coal is planned or in progress. Substantial obstacles, however, have frustrated extensive development and use of methane gas deposits in coal seams.

The foremost problem in producing methane gas from coal seams is recovery efficiency of the gas from the coal. Recovery efficiency in coal varies widely, and in coals where the recovery efficiency is low, vertical well developments obtain only a small amount of gas from around the well. Further, some coal deposits are not amenable to pressure fracturing and other methods often used for increasing gas production from rock formations. As a result, once the gas easily drained from a vertical well bore in a coal seam is produced, further production in some coal is limited in volume. Additionally, coal seams are often associated with subterranean water, which must be drained from the coal seam in order to produce the methane.

Horizontal drilling patterns have been tried in order to extend the amount of coal seams exposed to a drill bore for gas extraction. Such horizontal drilling techniques, however, require the use of a radiused well bore which presents difficulties in removing the entrained water from the coal seam. In most instances, pumping water from a vertical bore is more efficient and less expensive than pumping water from a horizontal or radiused bore.

Systems based on horizontal bores that intersect the cavity in a vertical well bore combine the advantages of horizontal drainage patterns with the efficiency associated with pumping from a vertical well bore. Liners, often installed to enhance the structural integrity of the bores, are joined at the intersections between lined bores by junctions installed using various techniques.

SUMMARY

The present invention provides an improved method and system for accessing subterranean zones from the surface. In one aspect, the present invention provides an articulated well bore coupled to a well bore pattern that provides access to a large subterranean area from the surface. The well bore pattern includes two or more well bores, one or more of which can, in some instances, be lined. In illustrative embodiments, the articulated well bore and well bore pattern can be coupled to a vertical well bore. The vertical well bore allows entrained water, hydrocarbons, and other deposits to be efficiently removed (e.g. by pumping the fluid, by using a gas lift, or by natural flow from the well) and/or produced. In some illustrative embodiments, the articulated well bore and well bore pattern can be coupled to a cavity that functions as a junction between multiple lined bores. In some illustrative embodiments, the cavity is packed with gravel (e.g. an unconsolidated mixture of pebbles, rock fragments, or other suitable packing material).

In another aspect, a method for accessing a subterranean zone includes forming a subterranean cavity coupled to a land surface; and forming a plurality of substantially horizontal bores extending at least partially into the subterranean zone and intersecting the cavity.

In another aspect, a system for accessing a subterranean zone includes a subterranean cavity coupled to a land surface, and a plurality of substantially horizontal bores extending at least partially into the subterranean zone and intersecting the cavity.

In another aspect, a method of accessing a coal seam includes forming a cavity proximate the coal seam and coupled to a land surface, gravel packing at least a portion of the cavity; and producing fluid from the cavity to the land surface. The phrase "proximate" a seam or zone is defined herein as near or intersecting the seam or zone.

In another aspect, a system for accessing a coal seam includes a cavity proximate the coal seam and coupled to a land surface wherein at least a portion of the cavity is packed with gravel.

In some embodiments, forming the cavity can include forming the cavity (e.g. a cavity including a substantially cylindrical portion) proximate the subterranean zone. Forming a subterranean cavity coupled to a land surface, forming a first bore (e.g. a substantially vertical bore) extending from the land surface, and forming a cavity in the well bore.

In some instances, forming a plurality of substantially horizontal bores extending at least partially into the subterranean zone and intersecting the cavity includes forming an articulated bore (e.g. an articulated bore offset horizontally from the first bore) extending from a land surface to proximate the subterranean zone and forming the plurality of substantially horizontal bores from the articulated bore. The first bore and the articulated bore can extend from the land surface through an entry bore. In some instances, the subterranean zone can be a portion of coals seam. In some instances, the horizontal bores can be horizontal drainage bores (e.g. bores with liners adapted to communicate fluid between an interior of the liner and the cavity).

In some embodiments, these aspects can also include installing a liner in two or more of the plurality of substantially horizontal bores. In some instances, such liners can terminate proximate the cavity. In other instances, at least one of the liners traverses the cavity.

In some embodiments, the aspects can also include gravel-packing at least a portion of the cavity.

In some embodiments, these aspects can also include withdrawing fluid from the cavity to the land surface through the first bore. In some instances, withdrawing fluid includes providing artificial lift (e.g. pumping the fluid or using a gas lift) to raise the fluid from the cavity to the land surface. In some instances, the systems can include a pump inlet in the first bore.

The above discussions of aspects of the invention include, for clarity of description, language putting necessary elements in context (e.g. coupled to a land surface). This language is not be construed as necessary elements of an individual aspect.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements. The drawings are not to scale.

DETAILED DESCRIPTION

Figure 1A:
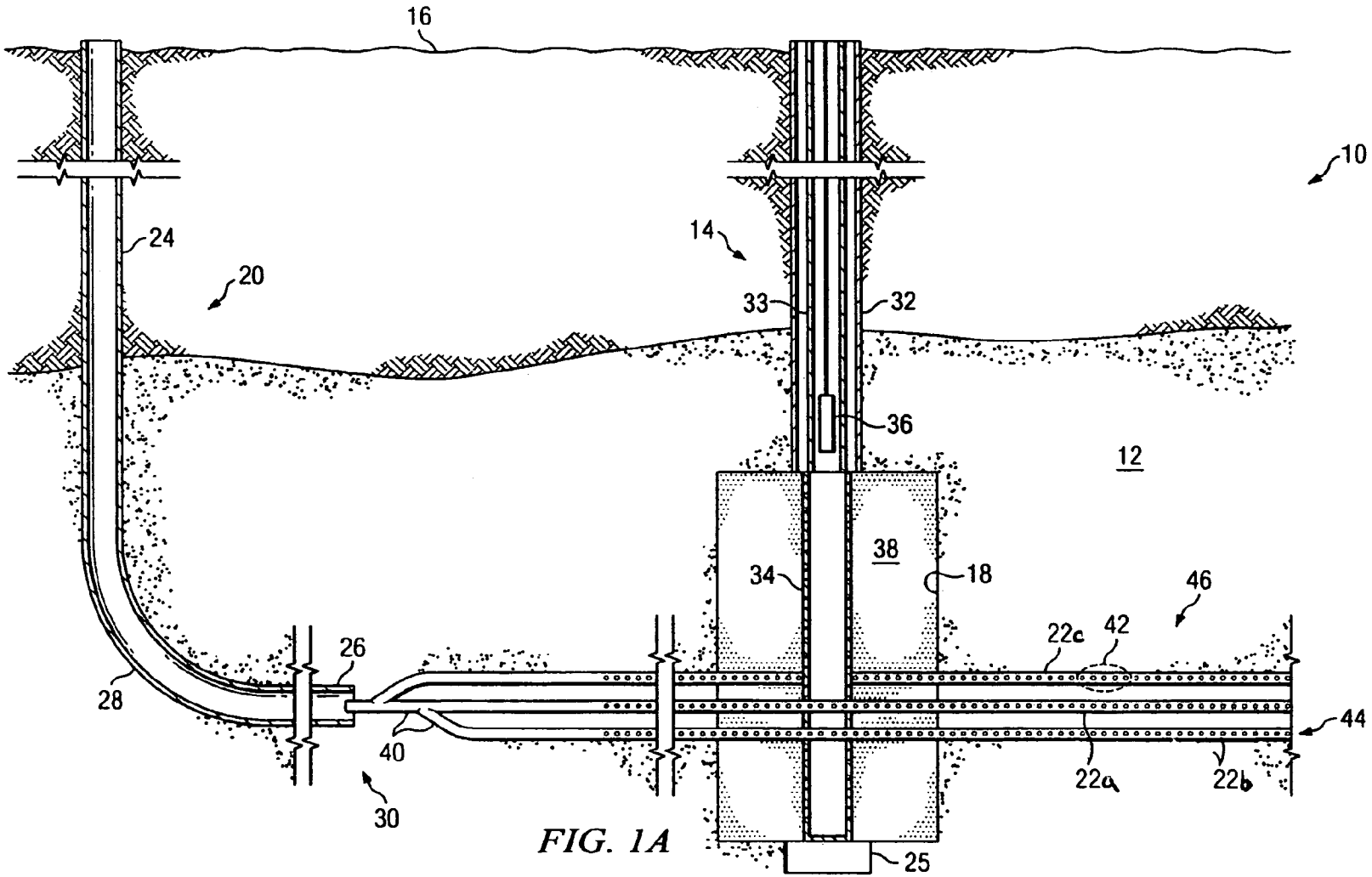
FIG. 1A is a schematic side view of an illustrative system for accessing a subterranean zone.

Referring to FIG. 1A, an illustrative system 10 for accessing a subterranean zone 12 includes a well bore 14, a cavity 18, and articulated well bore 20, and one or more substantially horizontal bores 22 (three (22*a*, 22*b*, 22*c*) are shown). In this case, the subterranean zone 12 is in a coal seam. However, in other applications, the system 10 can be used to access subterranean zones in other types of formations. For example, the system 10 can be used to access other subterranean zones to remove and/or produce water, hydrocarbons, and other fluids from the zone and to treat minerals in the zone prior to mining operations.

In this instance, the well bore 14 is substantially vertical and will be referred to as the substantially vertical well bore for descriptive purposes. However, embodiments of the systems described below can be implemented where at least a portion of the well bore is a slanted bore.

The substantially vertical well bore 14 extends from a land surface 16 (e.g. directly from the land surface itself, from an entry bore extending directly from the land surface, or from another near-surface feature) to the subterranean zone 12 where the cavity 18 formed in the substantially vertical well bore. In some instances, the cavity 18 is reamed or cut in a cylindrical shape with a diameter that is greater than the diameter of the substantially vertical well bore 14. In other instances, the cavity 18 has a diameter that is approximately equal to or less than the diameter of the vertical well bore 14. The substantially vertical well bore 14 is lined with a suitable well casing 32 that terminates above an upper surface of the cavity 18. An apertured liner 34 extends from the well casing 32 into the cavity 18. The apertures can be holes, slots, or openings of any other suitable size and shape. The apertured liner 34 can be an expandable liner that is expanded radially when positioned in the cavity 18 to both increase the diameter of the liner and increase the transverse dimension of the apertures therein. In the embodiment of FIG. 1, an inlet 36 of a down-hole pump, such as a sucker rod pump, electric submersible pump, or other type of pump, is located within the well casing 32 slightly above the cavity 18; however, the inlet 36 may be positioned elsewhere. For example, the inlet 36 may be positioned in the apertured liner 34 within the cavity 18.

The articulated well bore 20 extends from the land surface 16 towards the cavity 18 of the substantially vertical well bore 14. The articulated well bore 20 includes a first portion 24, a second portion 26, and a curved or radiused portion 28 interconnecting the first and second portions 24 and 26. In some instances, the first portion 24 is substantially vertical bore, and in other instances, the first portion is a slanted bore. The second portion 26 lies substantially in the horizontal plane of the formation (coal seam) and may follow any up or down dip of the formation and can also have a general overall slope. The one or more (three shown) substantially horizontal bores 22 extend from the vicinity of an open end 30 of the second portion 26 of the articulated well bore 20 through the cavity 18 and into the subterranean zone 12. As with the second portion 26, the horizontal bores 22 lie substantially in the horizontal plane of the formation (coal seam) and may follow any up or down dip of the formation and can also have a general overall slope. In some instances, the general slope of the horizontal bores 22 is upwards from the cavity 18 towards the far ends of the horizontal bores 22 such that fluids in the bores are biased to flow towards the cavity 18.

The bores 22 have liners 40 with apertures 42 providing fluid communication between subterranean zone 12 and interior 44 of the liners 40 as well as between the interior of the liners 40 and the cavity 18. Consequently, it is not necessary to form junctions connecting the liners 40 of the bores 22 with each other or with the articulated well bore. In effect, the cavity 18 itself acts as a junction between the bores 22 and the vertical well (e.g. pumping fluid from inside the apertured liner 34 to the land surface 16 draws fluid from the coal seam through the bores and the cavity into the apertured liner 34). In a coal seam, the fluid can be water and entrained coal fines.

The cavity 18 is packed with gravel 38 encompassing the substantially horizontal bores 22 and the apertured liner 34. The gravel pack 38 helps support the cavity 18 and also acts to filter coal fragments out of pumped fluid before it enters the apertured liner 34 of the vertical well bore 14. In some instances, the gravel may be coarse because, for example, coal fragments breaking off from the coal seam tend to be larger than the sands, silts, and clays that are typically produced by pumping in other formations. For example, gravel with the mean diameter of between about 20 and about 30 mm can be used. The coarse gravel is different from finer gravel (i.e. gravel with a smaller mean diameter) used around the apertured liner when producing from a sandy formation. However, finer gravel can be used in accordance with the concepts described herein.

The substantially vertical well bore 14 is logged either during or after drilling in order to locate the exact vertical depth of the subterranean zone 12. The cavity 18 is formed in the substantially vertical well bore 14 at the level of the subterranean zone 12. In some instances, the cavity 18 is formed using suitable under-reaming techniques and equipment. Alternatively, other techniques and equipment (e.g. hydrojet technology) can be used. A vertical portion of the substantially vertical well bore 14 continues below the cavity 18 to form a sump 25 for the cavity 18. As described above, the cavity 18 provides a junction for intersection of the substantially vertical well bore by articulated well bore used to form a substantially horizontal drainage pattern 46 in the subterranean zone 12. The cavity 18 also provides a collection point for fluids drained from the subterranean zone 12 during production operations. In embodiments that include a sump 25, the sump also provides a collection point for fluids. In this illustrative embodiment, the cavity 18 has a radius of approximately two meters and a vertical dimension which approximates the vertical dimension of the subterranean zone 12.

Appropriate drilling techniques for installing the system 10 described in U.S. Pat. No. 6,357,523 issued to Zupanik which is incorporated herein, by reference, in its entirety. The discussion below focuses deviations from these methods due to differences in the systems being installed.

Conventional drilling operations can result in an "over balanced" drilling operation in which the hydrostatic fluid pressure in the well bore exceeds the reservoir pressure. This can lead to loss of drilling fluid and entrained cuttings into permeable formations. In systems with intersecting wells as described above, gas compressors can be used to circulate compressed gas down the substantially vertical well bore 14 and back up through the articulated well bore 20 to prevent over balance drilling conditions during formation of the horizontal bores 22. In some instances, this approach can be used to achieve "under balanced" drilling conditions (i.e. conditions in which pressure in the formation exceeds the pressure of the drilling mud). Alternatively, "under balanced" drilling conditions can be achieved by withdrawing fluid from the vertical bore 14 or by introducing foam into the drilling mud. Factors including rock stability influence the determination of whether "over balanced" or "under balanced" drilling conditions are most appropriate for a specific formation.

The first portion 24 of the articulated well bore 20 is offset a sufficient distance from the cavity 18 to permit the radius curved section 28 and any desired second section 26 to be drilled while leaving sufficient space to also drill so as to achieve the desired spacing between the separate bores 22 before they intersect the cavity 18. This spacing allows for an increase in the radius of the curved portion 28 to reduce friction in the articulated well bore 20 during drilling operations. As a result, reach of a drill string drilled through the articulated well bore 20 is increased over articulated bores with tighter radiuses.

The articulated well bore 20 is drilled using a drill string that includes a suitable down-hole motor and bit. A measurement while drilling (MWD) device is included in the drill string for controlling the orientation and direction of the well bore drilled by the motor and bit. The first portion 24, the curved portion 28, and at least part of the second portion 26 of the articulated well bore 20 may be lined with a suitable casing.

Figure 1B:
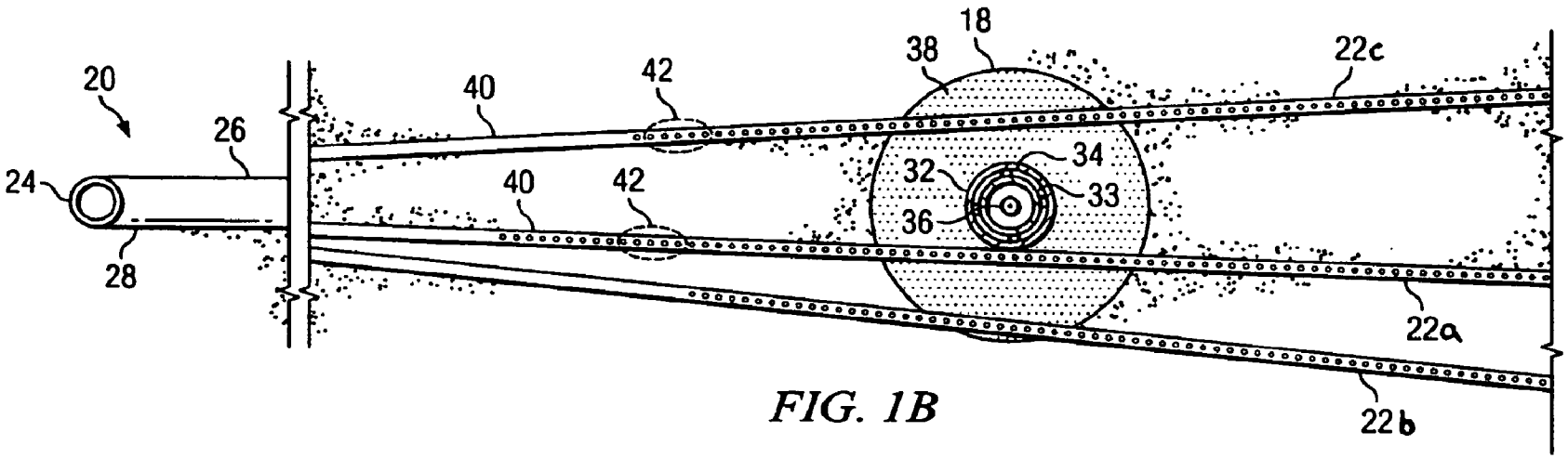
FIG. 1B is a plan view of the system of FIG. 1A.
Figure 1C:
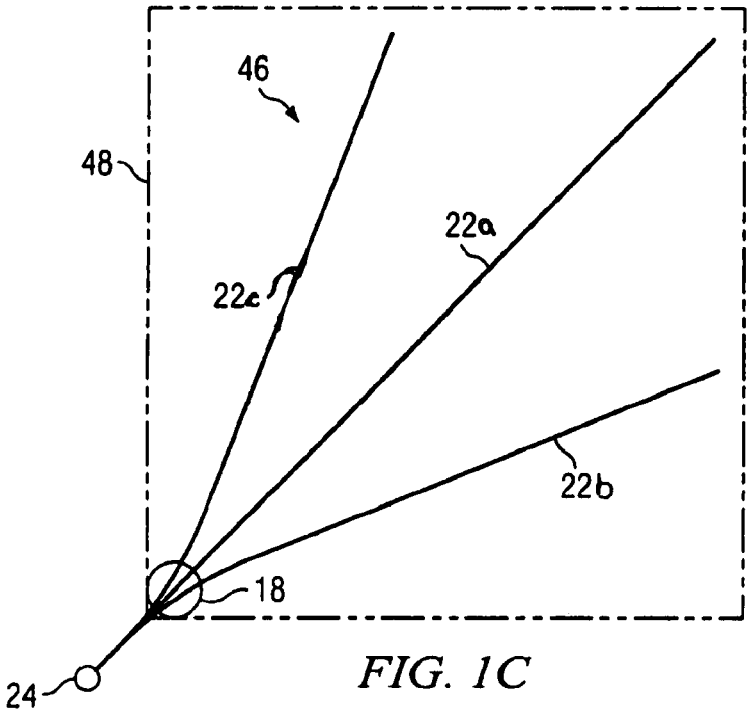
FIG. 1C is a plan view of the system of FIG. 1A at a greatly reduced scale.

Now referring also to FIGS. 1B-1C, after the articulated well bore 20 is drilled and cased, appropriate horizontal drilling apparatus (e.g. a mud motor with a bit attached to a running string) is used to drill a first horizontal bore 22*a*. The first horizontal bore 22*a* extends from the end of the second portion 26 through the cavity 18 and into the zone 12. The first horizontal bore 22*a* is oriented to pass through the cavity 18 so as to leave sufficient space for a working string or tubing to be inserted while filling the cavity 18 with gravel. The substantially horizontal bores 22 include sloped, undulating, or other inclinations of the subterranean zone 12. During this operation, gamma ray logging tools and measurement while drilling devices may be employed to control and direct the orientation of the drill bit to retain the drainage pattern 46 within the confines of the subterranean zone 12 and to provide substantially uniform coverage of a desired area within the subterranean zone 12. The term "drainage pattern" as used herein refers to two or more horizontal bores extending into the subterranean zone 12. Drainage pattern 46 extends laterally towards the boundary line 48 of the drainage area.

The order in which individual horizontal bores are drilled can be varied. The terms "first," "second," and "third" are used simply describe the process of forming the horizontal bores rather to denote a specific horizontal bore 22.

After the first horizontal bore is drilled, the drilling apparatus is withdrawn and liner 40, mounted on a running tool, is extended through the articulated well bore 20 and into the first horizontal bore 22*a*. After the liner 40 reaches the end of the first horizontal bore 22*a*, the running tool is operated to release the liner 40 and is then withdrawn. The second horizontal bore 22*b* is deflected from the first horizontal bore 22*a* using a directional drilling assembly or a whipstock. The location and angle of deflection are chosen such that the second horizontal bore 22*b* is oriented to intersect and pass through the cavity 18 again leaving a space clear for a working string or tubing to be inserted while filling the cavity with gravel. This orientation is also set such that the second horizontal bore 22*b* extends into the zone at an angle which achieves lateral separation from the first horizontal bore 22*a* to form part of the desired drainage pattern 46.

The drilling apparatus is then withdrawn and the liner 40 for the second horizontal bore 22*b* is then installed using the process already described. The drilling and lining process is reapeated using a slightly different deflection location and angle to form the third horizontal bore 22*c*. The locations where the second and third horizontal bores 22*b*, 22*c* deflect, or kick off, from the first horizontal bore 22*a* maybe separated along the length of the first horizontal bore 22*a*. In some instances, the bores are separated by about 3 meters. The liners 40 can be provided with apertures before they are installed or can be perforated downhole.

In this illustrative embodiment, the liners 40 extend from the distal ends of the horizontal bores 22 back through the cavity 18 to or near the proximal ends of the horizontal bores. In the second, third and subsequent horizontal bores 22, the liners 40 terminate near the kick off point of the bore from the first horizontal bore 22*a*. Because the liner 40 terminate near the kick off point, if a liner 40 is unintentionally run into a bore that has been previously lined, the liner 40 will travel only a short distance into the bore before colliding with the previously placed liner.

In this illustrative embodiment, the cavity is filled with gravel after the horizontal bores 22 are drilled and lined. Tubing 33 or a working string is inserted through the vertical well bore 14 and into the cavity 18. As discussed above, the horizontal bores 22 are installed so as to leave space in the center of the cavity 18 for subsequent installation of the apertured liner 34. The tubing 33 or working string extends into the space towards the lower portion of the cavity 18. A gravel slurry is pumped down into the cavity 18 through the tubing 33. The tubing 33 or working string is withdrawn as gravel fills the cavity 18. Keeping the end of the tubing 33 or working string near the top of the gravel pack provides feedback as to the level of gravel in the cavity 18 and allows up-and-down motion of the tubing 33 or working string to be used to 'tamp' the gravel down. In other embodiments, the gravel slurry is pumped down an annulus between a working string and the casing 32 of the vertical well bore 14. The fluid portion of the gravel slurry is pumped out through the working string leaving the gravel in place in the cavity 18. Other approaches (e.g. pumping a gravel slurry down the interior of a working string to a crossover tool which discharges it out of the working string) can also be employed to install the gravel pack.

In this embodiment, the apertured liner 34 is installed after the gravel pack 38 is in place. Thus, the apertured liner 34 can be provided with an end cap or tip at least a portion of which is conical, fustoconical, hemispherical, otherwise pointed or another shape that facilitates driving the liner 34 through the gravel pack 38. Driving the liner 34 through the gravel pack 38 takes advantage of both the compressibility of the gravel pack 38 (i.e. compressing the gravel pack 38) and any resilience of the formation itself. In particular, coal seams typically exhibit some degree of "give" in response to such pressure. If the apertured liner 34 is of an expandable type, expansion of the liner also compresses the gravel pack 38. After the apertured liner 34 is in place, the running tool and working string are withdrawn. An alternative embodiments, the apertured liner 34 is placed in the cavity 18 before the gravel pack 38 is installed with the gravel slurry pumped into the cavity 18 around the apertured liner 34. As discussed above, the apertured liner is attached to the tubing 33.

Liquid (e.g. water and entrained coal fines in a coal seam) collected in the cavity 18 and/or the sump 25 is withdrawn through bore 14 while gas is withdrawn through bore 14 or bore 20. If the system 10 is being used for injection, fluid may be input through either bore 14 or bore 20. The pump inlet 36 is installed in the vertical well bore 14 after the apertured liner 34 and gravel pack 38 are in place. The pump inlet 36 can be positioned within the casing or within the apertured liner 34.

The apertured liners 40 of the horizontal bores are exposed to both the subterranean zone 12 and the cavity 18 containing the apertured liner 34. The resulting fluid communication between the zone 12 and the substantially vertical bore 14 means that is not necessary to construct and line multi-lateral junctions joining the horizontal bores 22 to each other and/or to the vertical bore 14. As discussed above, the cavity 18, in effect, acts as the junction.

Figure 2B:
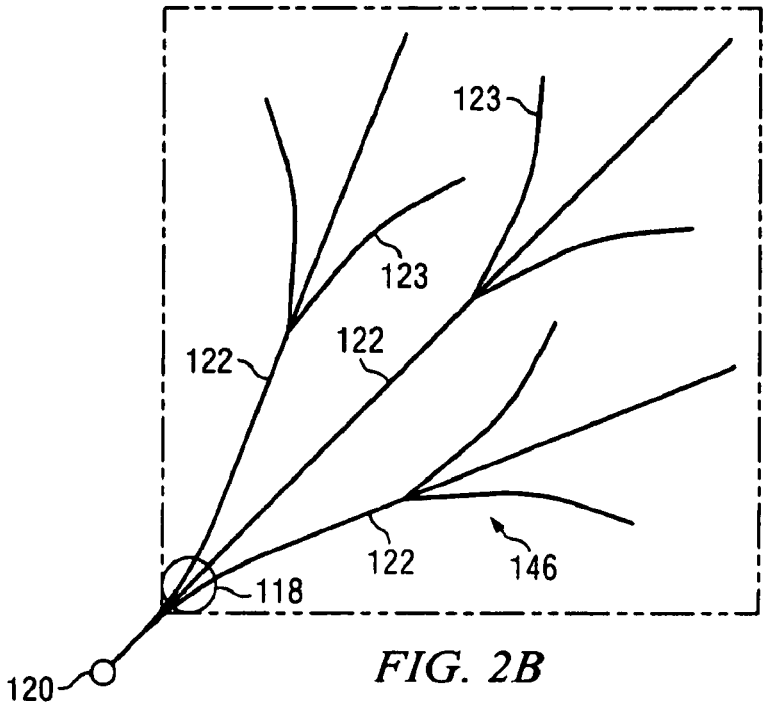
FIG. 2B is a small-scale plan view of the system of FIG. 2A.
Figure 2A:
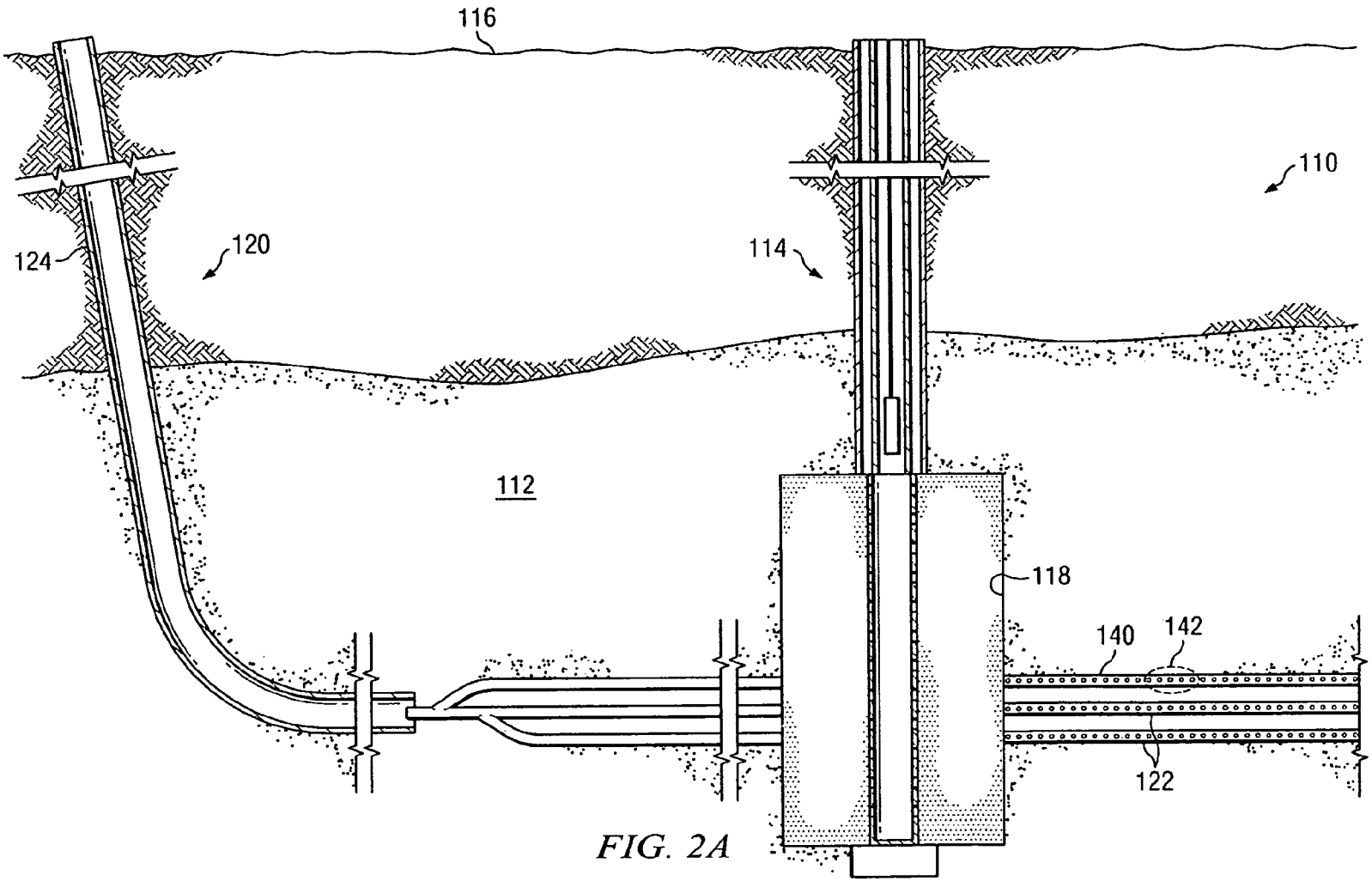
FIG. 2A is a schematic side view in of another illustrative system for accessing a subterranean zone.

Referring to FIGS. 2A-2B, another illustrative system 110 for accessing a subterranean zone 112 also includes a well bore 114, a cavity 118, an articulated well bore 120 and one or more (three shown) substantially horizontal bores 122. The articulated well bore 120 is shown with a slanted first portion 124, rather than a substantially vertical first portion as above, extending downward from the land surface 116 to the subterranean zone 112. Multiple slanted bores can extend from a single entry location, entry bore, or drilling pad towards multiple cavities for multiple drainage patterns extending in different directions. The horizontal bores 122 have liners 140 with apertures 142 only in the portions of the horizontal bores that extend beyond the cavity 118. In other embodiments of this aspect of the invention, the first portion 124 of the articulated well bore 120 can be a substantially vertical, rather than slanted, bore.

After a horizontal bore 122 has been drilled and a liner 140 is installed therein, a subsequent horizontal bore 122 may be drilled and a liner 140 placed in the latter drilled horizontal bore 122. Although the liner 140 is inserted back through the articulated well bore 120 and oriented to enter the latter drilled horizontal bore 122, the liner 140 may sometimes inadvertently enter a horizontal bore 122 that has already been lined. Because the liner 140 in the previously lined horizontal bore 122 terminates about the far side of the cavity 118, it may not be apparent that the liner 140 being run-in is entering a previously drilled and lined horizontal bore 122 until after the liner 140 has traversed the cavity 118.

In this system, the horizontal drainage system 146 is shown laid out with an optional herringbone pattern. Each of the horizontal bores 122 has one or more laterals 123 extending into the subterranean zone 112. These laterals 123 may also be lined, and their liners can be tied back to the liners of the horizontal bores 122 using cavities as described herein or with other types of tieback systems. Horizontal drainage patterns are laid out according to the characteristics of the formation and the access desired by the designer. Therefore, other patterns (e.g. pinnate patterns) can be used with this system as appropriate.

Figure 3:
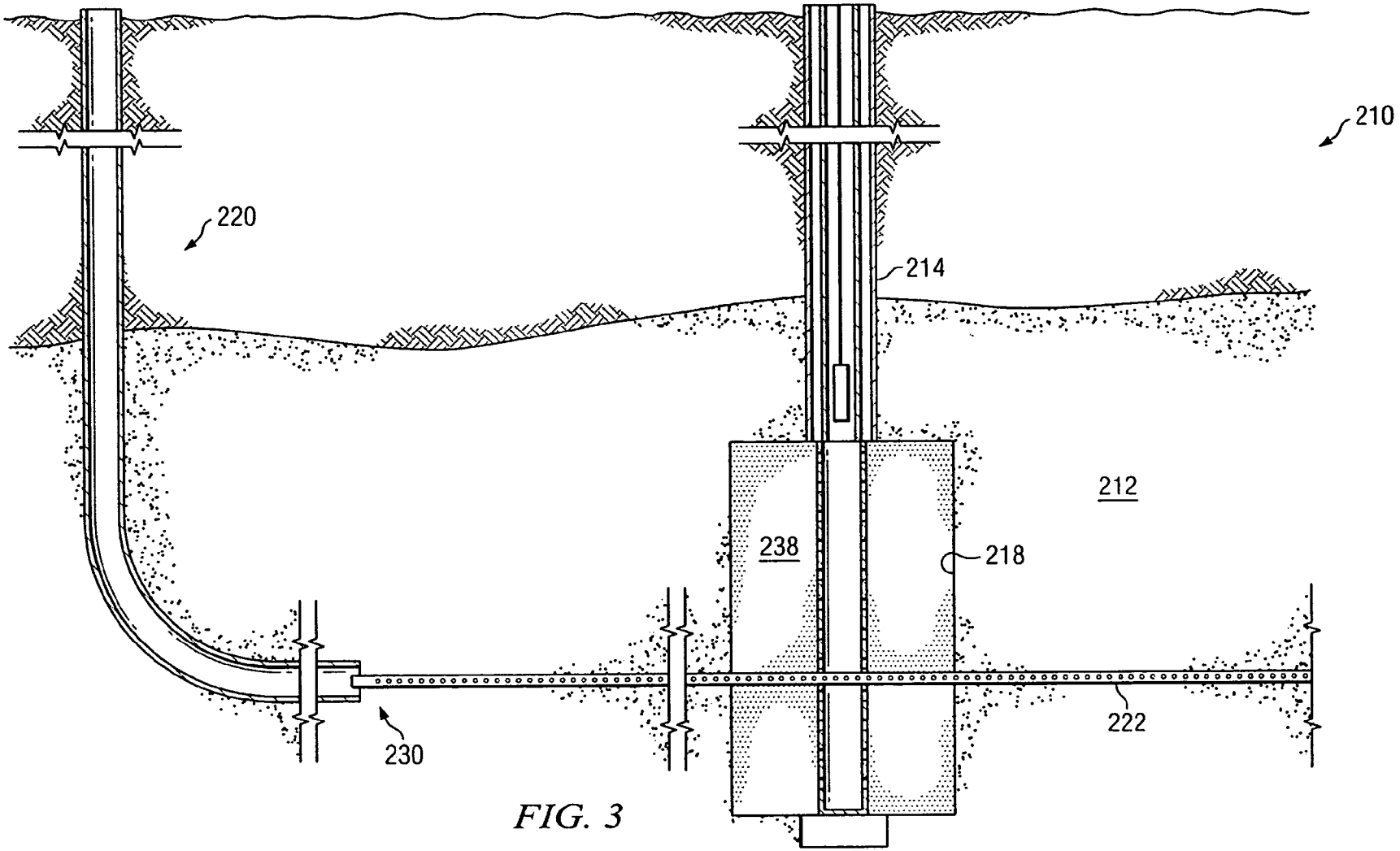
FIG. 3 is a schematic side view of another illustrative system for accessing a subterranean zone.

Referring to FIG. 3, another illustrative system 210 also includes a substantially vertical bore 214, a cavity 218 with an associated gravel pack 238, and an articulated well bore 220. System 210 includes a single horizontal drainage bore 222 extending from the vicinity of an opening 230 of the articulated well bore 220 through the cavity 218 and into the subterranean zone 212. In some applications, only the single horizontal drainage bore 222 extends into the subterranean zone. In other applications, multiple lateral bores (not shown) are installed extending from the single horizontal drainage bore 222.

Figure 4:
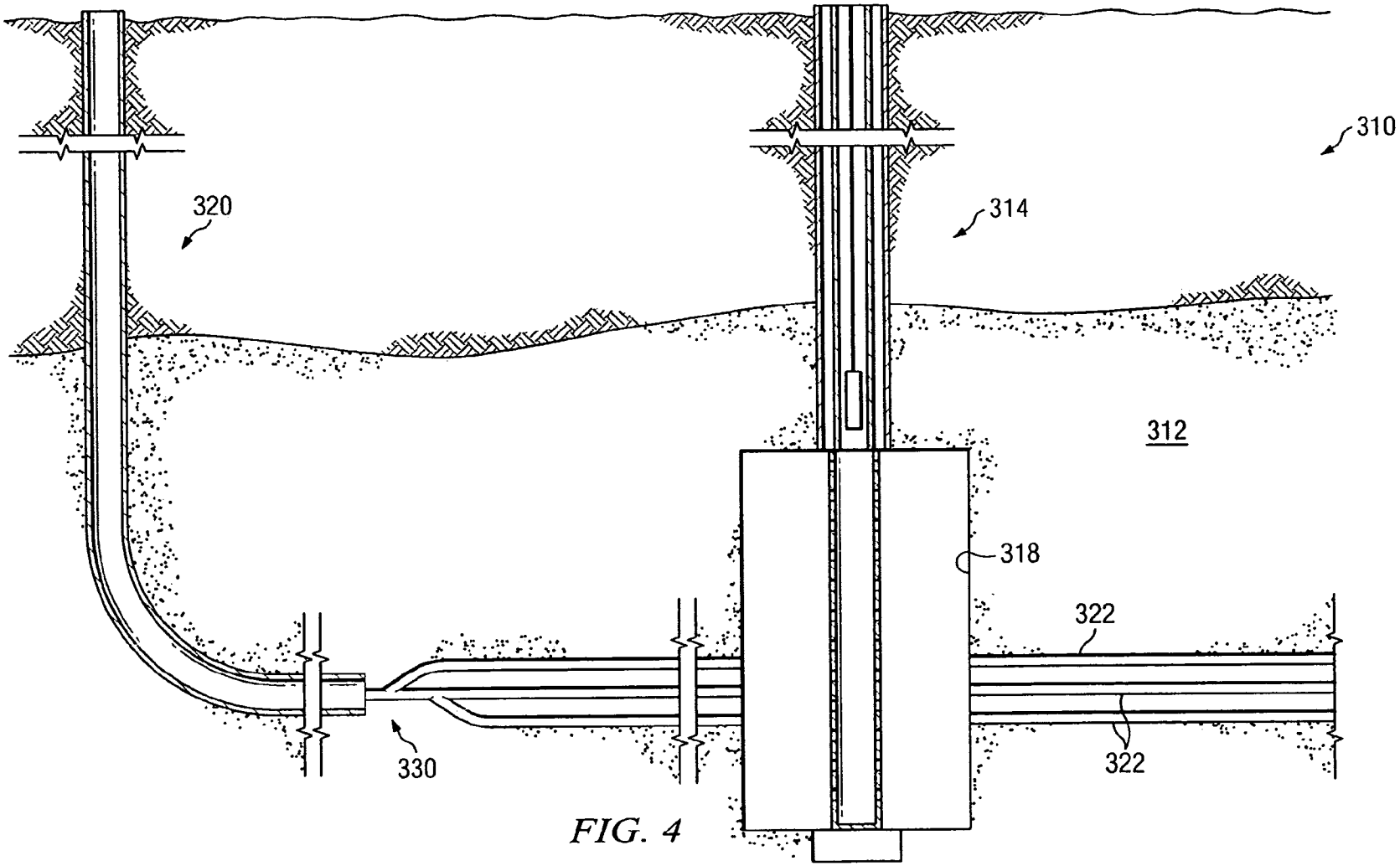
FIG. 4 is a schematic side view of another illustrative system for accessing a subterranean zone.

Referring to FIG. 4, another illustrative system 310 includes a substantially vertical bore 314, a cavity 318, and an articulated well bore 320. One or more (three shown) horizontal bores 322 are drilled extending from the vicinity of an opening 330 of the articulated well bore 320 through the cavity 318 and into the subterranean zone 312. The cavity 318 provides a bigger target for interception than a vertical well would. This system does not include liners in the bores 322 and does not include a gravel pack in the cavity. This system is made and used similarly to the systems described above with the exception that the liners and gravel pack are not installed. As above, the cavity 318 collects liquids that can be produced from the vertical bore 314. Gas can be produced from the vertical or articulated bores 314, 320.

Figure 5:
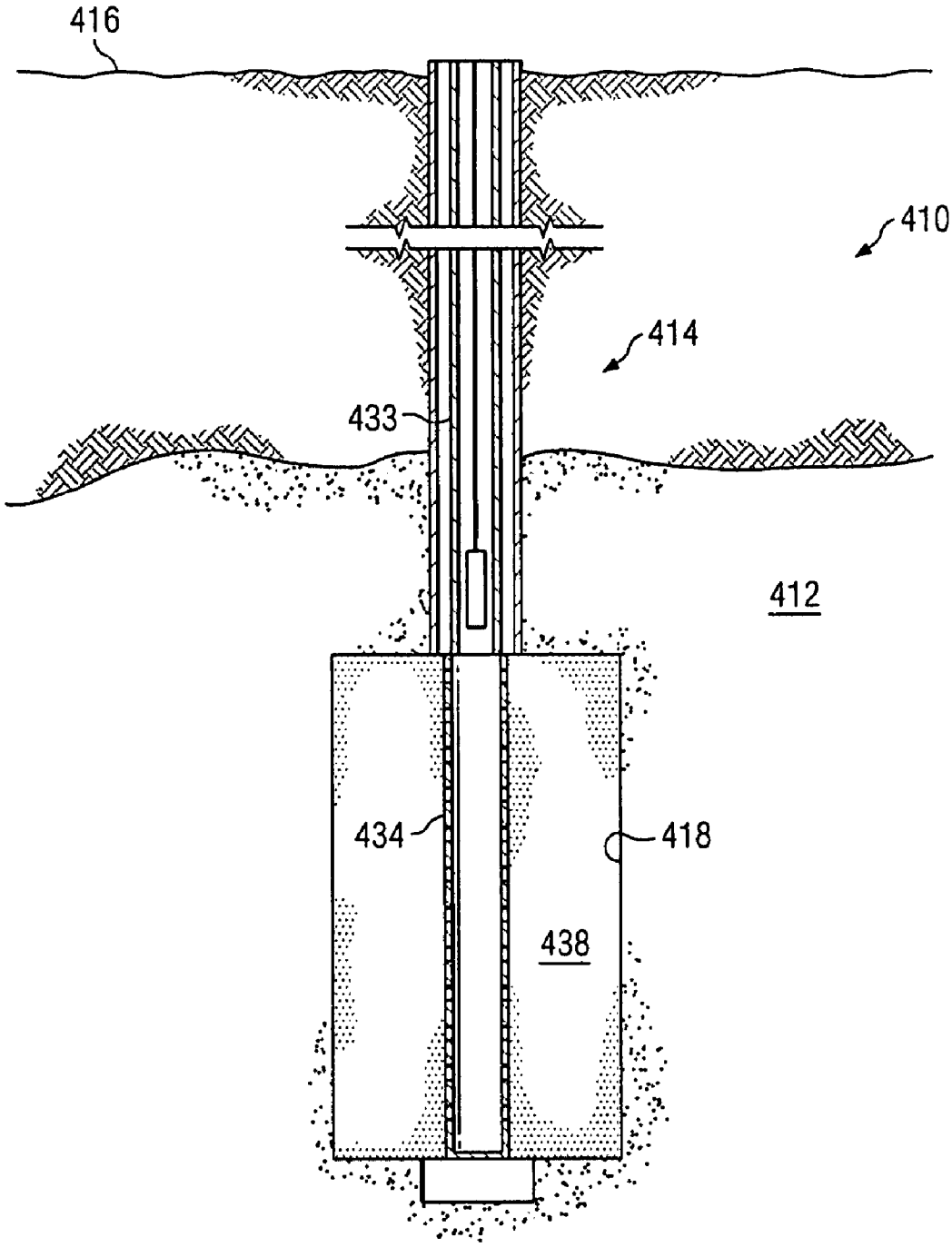
FIG. 5 is a schematic side view of another illustrative system for accessing a subterranean zone.

Referring to FIG. 5, another illustrative system 410 includes a substantially vertical bore 414 extending from a land surface 416 to a subterranean zone 412 and a cavity 418 in the subterranean zone. The cavity 418 is formed in the vertical bore 414 and contains a gravel pack 438 installed around a apertured liner 434. The apertured liner 434 is attached to tubing 433 that extends to the land surface 416 through the vertical bore 414. No horizontal bores are included in the system 410. The vertical bore 414 and the cavity 418 are made and used similarly to those described above with the exception that fluid flows into the cavity directly from the surrounding zone 412 rather than being routed through connected horizontal bores.

A number of embodiments of the invention have been described. Nevertheless, it will be understood that various modifications may be made without departing from the spirit and scope of the invention. For example, although the illustrative systems included at most three (e.g. zero, one, or three) horizontal bores, some embodiments include four or more horizontal bores intersecting a cavity in a subterranean zone. In another example, although the discussions above have focused on applications where fluids are being withdrawn from a subterranean zone, these systems can also be used for injection of fluids into or sequestration of fluids into a formation. Accordingly, other embodiments are within the scope of the following claims.

What is claimed is:

1. A method for accessing a subterranean zone, the method comprising:

forming a first bore extending from a land surface and forming a subterranean cavity in the well bore; and forming an articulated bore extending from a land surface to proximate the subterranean zone and forming a plurality of substantially horizontal bores from the articulated bore, the plurality of substantially horizontal bores drilled through the cavity and extending at least partially into the subterranean zone.

2. The method of claim 1 wherein forming the cavity comprising forming the cavity proximate the subterranean zone.

3. A method for accessing a subterranean zone, the method comprising:

forming a first bore extending from a land surface and forming a subterranean cavity in the well bore;

forming an articulated bore extending from a land surface to proximate the subterranean zone and forming a plurality of substantially horizontal bores from the articulated bore, the plurality of substantially horizontal bores drilled through the cavity and extending at least partially into the subterranean zone; and installing a liner in two or more of the plurality of substantially horizontal bores.

4. The method of claim 3 wherein at least one of the liners terminates proximate the cavity.

5. The method of claim 3 wherein at least one of the liners traverses the cavity.

6. A method for accessing a subterranean zone, the method comprising:

forming a first bore extending from a land surface and forming a subterranean cavity in the well bore;

forming an articulated bore extending from a land surface to proximate the subterranean zone and forming a plurality of substantially horizontal bores from the articulated bore, the plurality of substantially horizontal bores drilled through the cavity and extending at least partially into the subterranean zone; and gravel-packing at least a portion of the cavity.

7. The method of claim 6 further comprising inserting an apertured liner vertically into the portion of the cavity that has been gravel-packed.

8. The method of claim 7 further comprising radially expanding the liner.

9. The method of claim 1 wherein the cavity includes a substantially cylindrical portion.

10. The method of claim 1 wherein forming the first bore comprises forming a substantially vertical bore.

11. The method of claim 1 wherein the articulated bore is offset horizontally from the first bore.

12. The method of claim 1 wherein at least one of the first bore and the articulated bore extends from the land surface through an entry bore.

13. The method of claim 1 further comprising withdrawing fluid from the cavity to the land surface through the first bore.

14. The method of claim 13 wherein withdrawing fluid comprises at least one of providing artificial lift to raise the fluid from the cavity to the land surface and discharging from a flowing well.

15. The method of claim 14 wherein providing artificial lift comprises at least one of pumping the fluid and using a gas lift.

16. A system for accessing a subterranean zone, the system comprising:

a subterranean cavity coupled to a land surface by a first well bore; and a plurality of substantially horizontal bores drilled from a second well bore through the cavity and extending at least partially into the subterranean zone.

17. A system for accessing a subterranean zone, the system comprising:

a subterranean cavity coupled to a land surface by a first well bore;

a plurality of substantially horizontal bores drilled from a second well bore through the cavity and extending at least partially into the subterranean zone; and a liner in two or more of the plurality of substantially horizontal bores.

18. The system of claim 17 wherein at least one of the liners terminates proximate the cavity.

19. The system of claim 17 wherein at least one of the liners extends across the cavity.

20. A system for accessing a subterranean zone, the system comprising:

a subterranean cavity coupled to a land surface by a first well bore; and a plurality of substantially horizontal bores drilled from a second well bore through the cavity and extending at least partially into the subterranean zone;

wherein at least a portion of the cavity is gravel-packed.

21. The system of claim 16 wherein the cavity comprises a substantially cylindrical portion.

22. The system of claim 16 wherein the second well bore comprises an articulated bore extending from the land surface and coupled to the cavity by the plurality of substantially horizontal bores.

23. The system of claim 22 further comprising a pump inlet in the first bore.

24. A method of accessing a coal seam, the method comprising:

forming a cavity proximate the coal seam and coupled to a land surface;

forming a plurality of substantially horizontal bores drilled into and through the cavity and extending at least partially into the coal seam;

gravel-packing at least a portion of the cavity; and producing fluid from the cavity to the land surface.

25. The method of claim 24 wherein one or more of the plurality of substantially horizontal bores comprises a liner.

26. The method of claim 25 wherein one or more of the liners traverses the cavity.

27. The method of claim 24 wherein producing fluid comprises at least one of providing artificial lift to raise the fluid from the cavity to the land surface and discharging from a flowing well.

28. The method of claim 24 further comprising inserting an apertured liner vertically into the portion of the cavity that has been gravel-packed.

29. The method of claim 28 further comprising radially expanding the apertured liner.

30. A system for accessing a coal seam, the system comprising:

a cavity proximate the coal seam and coupled to a land surface by a first well bore; and a plurality of drainage bores drilled from a second well bore into the cavity;

wherein at least a portion of the cavity is packed with gravel.

31. The system of claim 30 wherein at least one of the drainage bores comprising a liner adapted to communicate fluid between an interior of the liner and the cavity.

* * * * *